United States Patent [19]

Brown

[11] Patent Number: 4,518,309

[45] Date of Patent: May 21, 1985

[54] HIGH SPEED PIPE HANDLING APPARATUS

[76] Inventor: Joe R. Brown, P.O. Box 19310, 5649 Tupper Lake, Houston, Tex. 77056

[21] Appl. No.: 302,708

[22] Filed: Sep. 16, 1981

Related U.S. Application Data

[63] Continuation-in-part of Ser. No. 258,923, Apr. 30, 1981, Pat. No. 4,444,536, which is a continuation-in-part of Ser. No. 35,933, May 4, 1979, abandoned.

[51] Int. Cl.[3] ..... B66F 11/02

[52] U.S. Cl. ..... 414/745; 92/24; 92/27; 254/29 R; 294/88; 414/22; 188/67

[58] Field of Search ..... 414/22, 745; 188/67; 294/88, 90, 91; 173/149; 254/29 R, 106; 92/24, 26–28; 24/263 D, 263 DA, 263 DT

[56] References Cited

U.S. PATENT DOCUMENTS

| | | | |
|---|---|---|---|
| 2,809,721 | 10/1957 | Knights | 188/67 |
| 2,867,338 | 1/1959 | Simmonds | 414/22 |
| 3,610,503 | 10/1971 | Pryor | 226/173 |
| 3,941,141 | 3/1976 | Robert | 92/24 X |
| 4,300,664 | 11/1981 | Helm et al. | 92/24 X |
| 4,348,044 | 9/1982 | Wood | 294/88 |

FOREIGN PATENT DOCUMENTS

| | | | |
|---|---|---|---|
| 312972 | 10/1971 | U.S.S.R. | 92/24 |

*Primary Examiner*—Robert J. Spar
*Assistant Examiner*—Donald W. Underwood
*Attorney, Agent, or Firm*—Browning, Bushman, Zamecki & Anderson

[57] ABSTRACT

High speed pipe handling apparatus is disclosed. A pipe gripping system includes fluid pressure piston-and-cylinder propulsion systems to manipulate pipe gripping slip members, and includes a mechanical latching system that locks the pistons to the cylinders in the pipe-gripping configuration by latch members. The latching system is released by application of fluid pressure.

25 Claims, 24 Drawing Figures

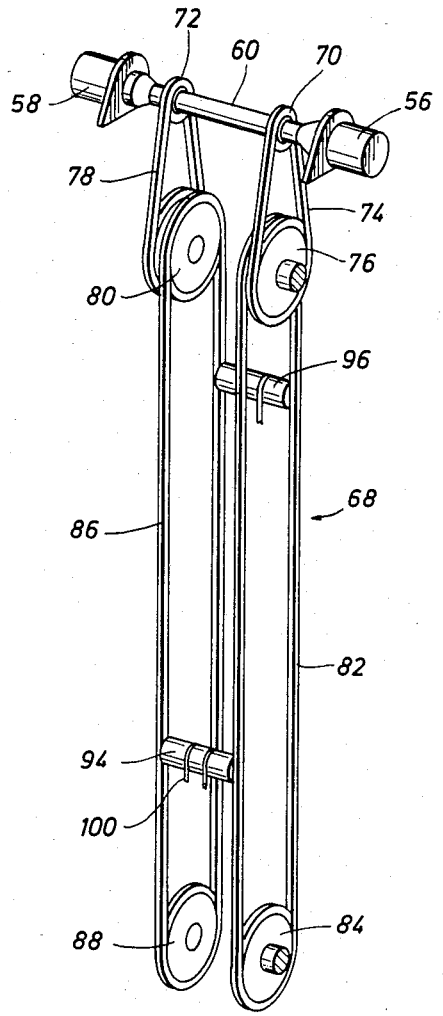
FIG. 7
FIG. 16
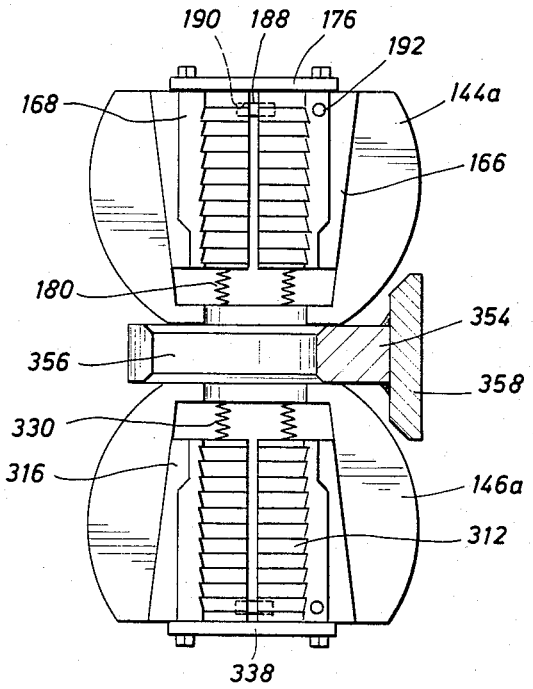
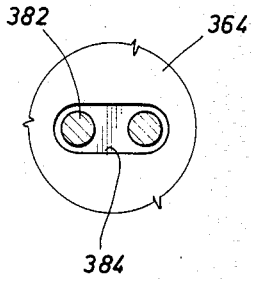
FIG. 17

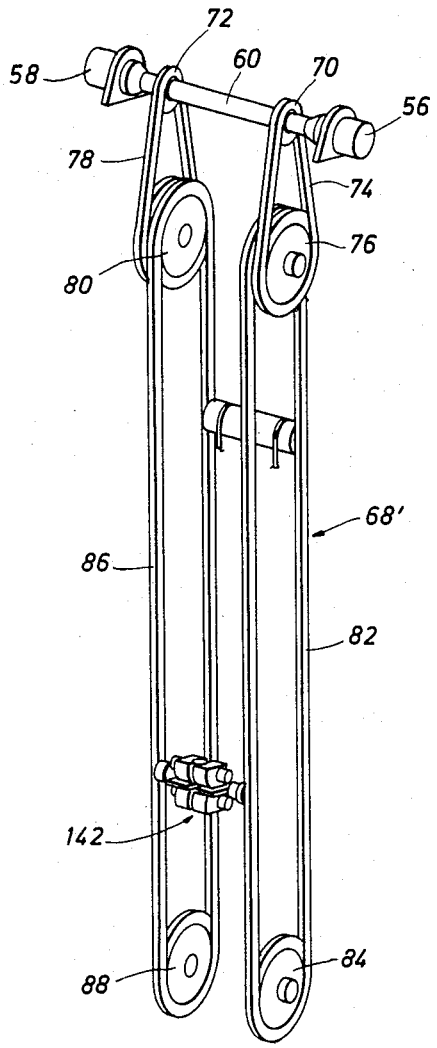
FIG. 11
FIG. 12 A
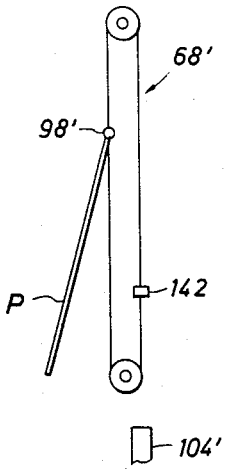
FIG. 12B
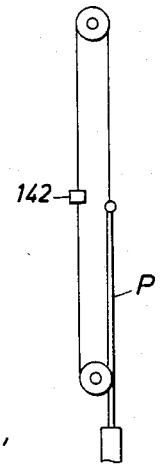
FIG. 12C
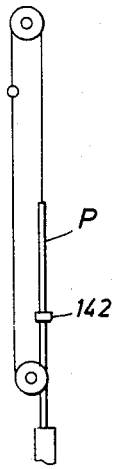
FIG. 12D
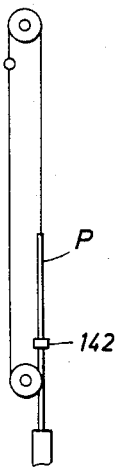
FIG. 12E
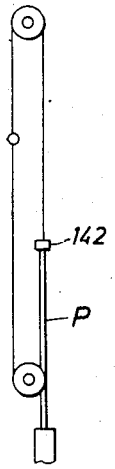

HIGH SPEED PIPE HANDLING APPARATUS

This is a continuation-in-part of application Ser. No. 258,923, filed Apr. 30, 1981, now U.S. Pat. No. 4,444,536, which is a continuation-in-part of application Ser. No. 35,933, filed May 4, 1979, now abandoned.

BACKGROUND OF THE INVENTION

1. Field of the Invention

The present invention pertains to apparatus and methods for manipulating tubular members. More particularly, the present invention relates to well working apparatus for manipulating pipe members into and out of wells.

2. Description of Prior Art

Well working rigs of considerable variety are known, and include design features to achieve special purposes. For example, rigs are known with fold-down masts sufficiently lightweight to be transportable by truck to and from well sites. It is desireable, particularly for economic purposes, to be able to transport virtually an entire rig on a single truck, and to be able to configure the mast for operating on a well in a short period of time after arrival at the well site.

Workover rigs, for performing operations on already-drilled wells, are generally small compared to rigs used to initially drill wells, and may even take the form of a snubber, a gin pole and a winch line. Such workover rigs are generally transportable by truck. However, such workover rigs may be limited to manipulating a single pipe member at a time as opposed to a drilling rig which can typically manipulate a stand of three pipe members threaded together. Similarly, snubbers used to drive pipe into wells under high pressure well conditions, for example, generally grip and manipulate one pipe member at a time, and operate over a stroke length typically of just a few feet. Consequently, a workover rig, for example, should be operable to manipulate pipe members rapidly so as to minimize the time required to withdraw a pipe string from a well, or to insert a pipe string into a well.

U.S. Pat. No. 4,267,675, which was filed concurrently with the aforementioned application Ser. No. 35,933 and which was issued May 19, 1981, discloses apparatus and methods for extending and locking a mast. The Ser. No. 35,933 application discloses apparatus and methods for high speed manipulation of pipe by means of a double closed-loop chain-operated well rig, utillizing a pair of elevators, for example, to handle two separate pipe members simultaneously. The Ser. No. 258,923 application discloses apparatus and methods for high speed snubbing of pipe into wells, for example. Pipe gripping apparatus is disclosed for mounting on the double chain drive of the Ser. No. 35,933 application rig so that pipe may be driven into a high pressure well, for example, by reciprocal motion of the chain loops. The gripping assembly includes fluid pressure operated propulsion apparatus for manipulating pipe gripping slips, wherein the slips may be automatically locked in engagement with a pipe member.

SUMMARY OF THE INVENTION

The present invention provides apparatus for manipulating members, such as pipe members, and includes an assembly comprising a fluid pressure cylinder circumscribing a fluid pressure piston, with the piston head cooperating with the cylinder to establish a first fluid pressure chamber. The piston is movable within the cylinder between first and second longitudinal positions, and may be propelled toward the first position by fluid pressure applied to the pressure chamber. Latch members are carried by the piston, mounted in apertures in the piston for radial movement relative to the piston between an extended configuration, in which the latch members are received in an internal profile, or groove, of the cylinder, and a retracted configuration in which the latch members are out of the profile. The piston apertures are in registration with the groove when the piston is in the first longitudinal position, but not when the piston is in the second position. A control member, such as a mandrel, is movable longitudinally within an internal chamber of the piston between a first position, in which the mandrel maintains the latch members in the extended configuration, and a second position in which the mandrel permits the latch members to be in the retracted configuration. With the piston in the first longitudinal position and the mandrel in its first position, the latch members thus lock the piston to the cylinder to limit relative axial movement therebetween A spring biases the mandrel toward the first position thereof; a second fluid pressure chamber is provided for receiving fluid pressure for propelling the mandrel toward its second position, releasing the piston for axial movement. Pressure in the second pressure chamber then propels the piston toward its second longitudinal position.

Apparatus for gripping pipe members is provided by two fluid pressure piston-and-cylinder assemblies as described above, arranged in opposed configuration for propelling pipe-gripping slips between a retracted configuration for gripping pipe members and an extended configuration for release of pipe members. The pistons are linked to the slips to manipulate the slips in response to fluid pressure applied to one or the other of the fluid pressure chambers of the respective piston-and-cylinder assemblies. A pipe gripping system may be provided according to the present invention with a first pipe gripping assembly as described for engaging pipe members and transmitting force thereto in one longitudinal direction sense of such pipe members, and a second gripping assembly provided for engaging such pipe members and transmitting force thereto in the opposite longitudinal direction sense of the pipe members.

Apparatus for manipulating pipe members according to the present invention may include a mast and two closed loop working chains extending along the mast in generally parallel paths between spocket wheels. Pipe gripping assemblies as described above may be joined to the continuous chains and movable therewith in response to a power source, such as a motor, whereby a pipe member may be gripped by a gripping assembly and manipulated by operation of the continuous chains.

The present invention provides pipe gripping apparatus which is selectively operable by application of fluid pressure to propel slips into gripping engagement with a pipe member, such that the gripping assembly is automatically locked in such gripping configuration by operation of biasing springs driving latch members into locking grooves in the slip-propelling apparatus. The slips may be released from gripping engagement with a pipe member by application of fluid pressure to the slip-propelling assemblies to both unlock the propelling assemblies and drive the slips away from the pipe member.

BRIEF DESCRIPTION OF THE DRAWINGS

FIG. 7 is a schematic perspective view of the chain and sprocket wheel assembly of a chain drive, Ferris wheel type well working rig;

FIG. 11 is a schematic perspective view of the chain and sprocket assembly similar to FIG. 7, but including a double snubbing head;

FIGS. 12A through 12E are schematic diagrams of a pipe member in various stages of being manipulated by the chain-mounted snubbing head of FIG. 11;

FIG. 16 is a vertical cross section of the dual snubbing head, taken along line 16—16 of FIG. 14;

FIG. 17 is a fragment view in vertical cross section taken along line 17—17 of FIG. 15 and showing the pin-and-slot arrangement of the swivel mounting of the snubbing head;

DESCRIPTION OF PREFERRED EMBODIMENTS

U.S. Pat. No. 4,267,675, application Ser. No. 35,933, an application Ser. No. 258,923 are incorporated herein by reference.

The present invention is included in apparatus for manipulating pipe members shown in FIGS. 1–20 as a chain operated Ferris wheel type well working rig mounted on a truck bed. The well working rig is shown at 10 in FIGS. 1–6, with details of the chain assembly shown in FIGS. 7 and 11. Methods of operation of the well working rig 10 are illustrated in FIGS. 8–10 and 12A–12E. FIGS. 11–20 particularly illustrate details of the construction, mounting and use of the high speed snubbing head of the present invention.

Figure 1:
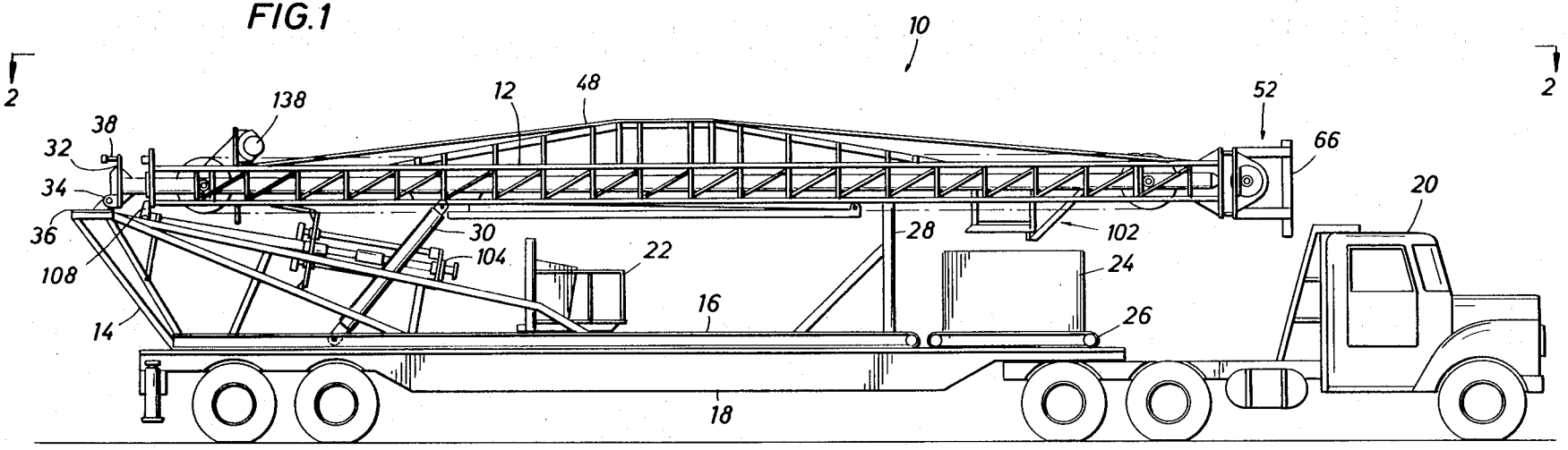
FIG. 1 is a side elevation of a chain drive, Ferris wheel type well working rig mounted on a truck bed and in collapsed and folded configuration.
Figure 2:
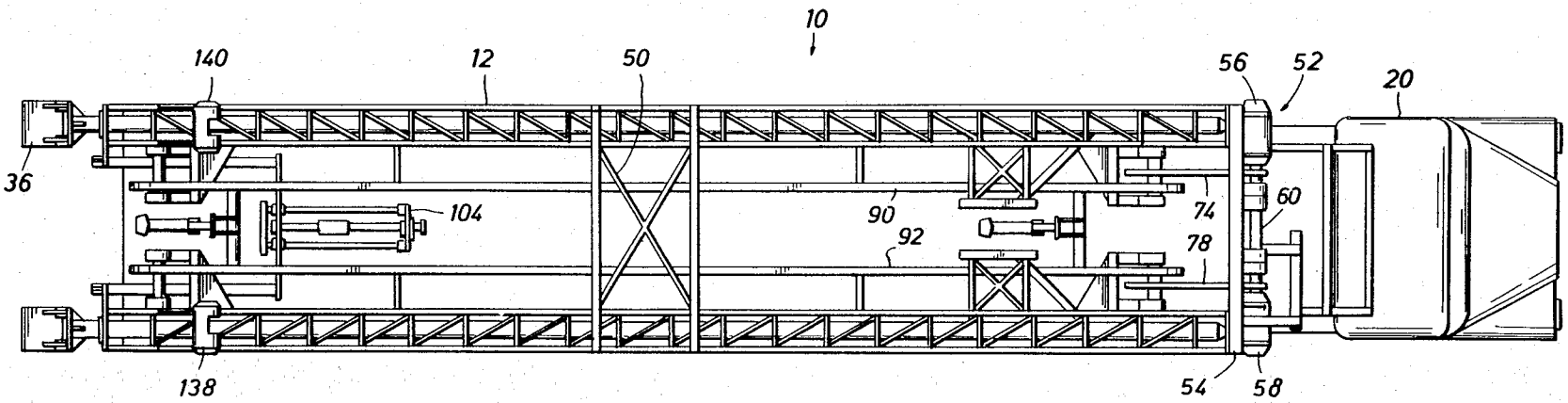
FIG. 2 is a top plan view of the well working rig as shown in FIG. 1, taken along line 2—2 of FIG. 1.

The well working rig 10 includes a mast 12 mounted, by means of a substructure frame 14, on a skid 16. The skid 16 is supported on a flatbed 18 propelled by a fifth-wheel type truck 20. In FIGS. 1 and 2 the mast is shown in a retracted and folded configuration, extending forward over the flatbed 18. A control console assembly 22 is also supported by the skid 16 (FIG. 1). A power assembly 24 is mounted on a separate skid 26 which is supported by the forward end of the flatbed 18.

As seen in FIG. 1 the substructure framework 14 extends beyond the back end of the skid 16. In the collapsed and folded configuration, the mast 12 also rests on a support framework 28 positioned on the forward portion of the skid 16.

Figure 3:
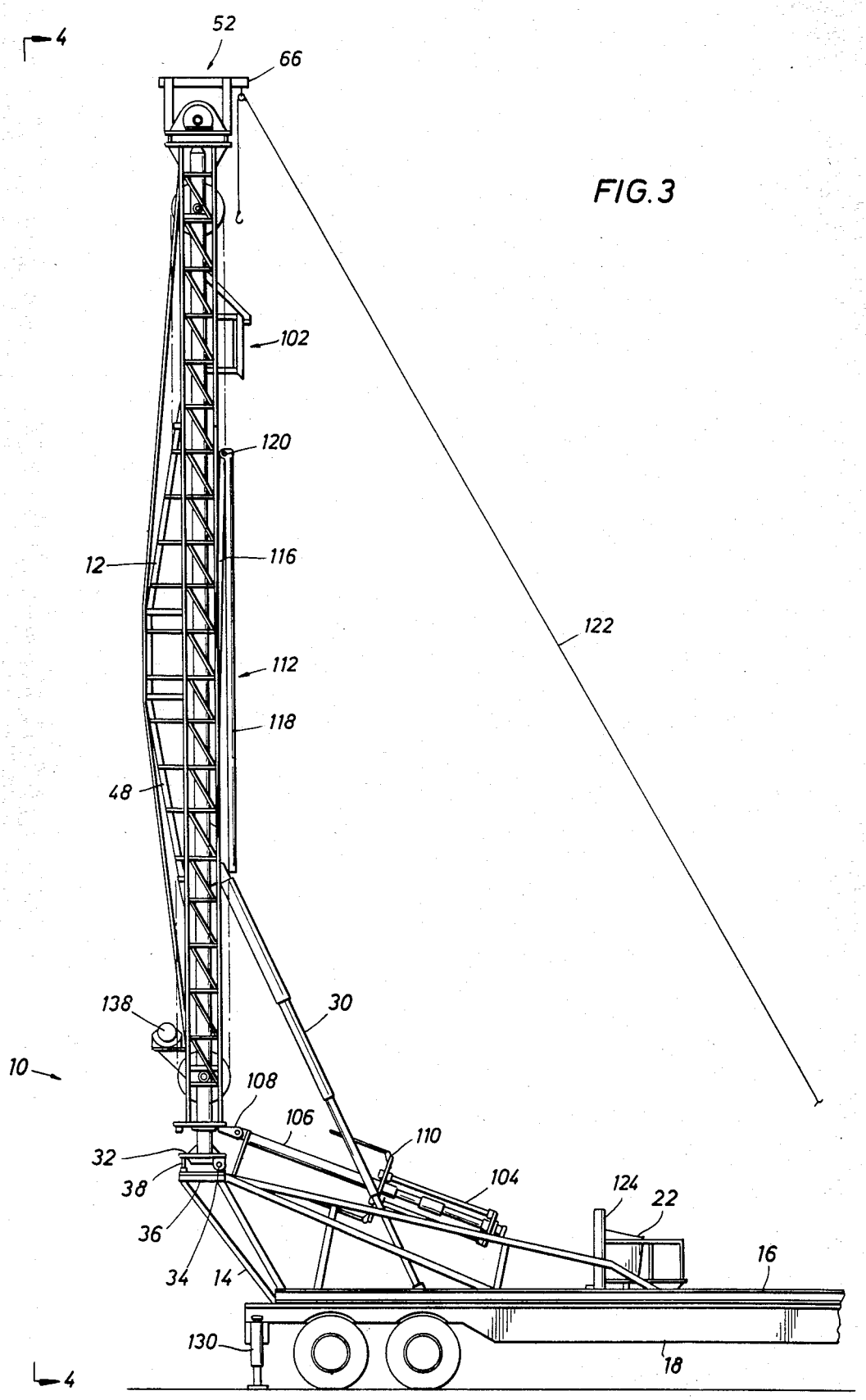
FIG. 3 is a partial side elevation of the rig of FIGS. 1 and 2, showing the mast erect.
Figure 4:
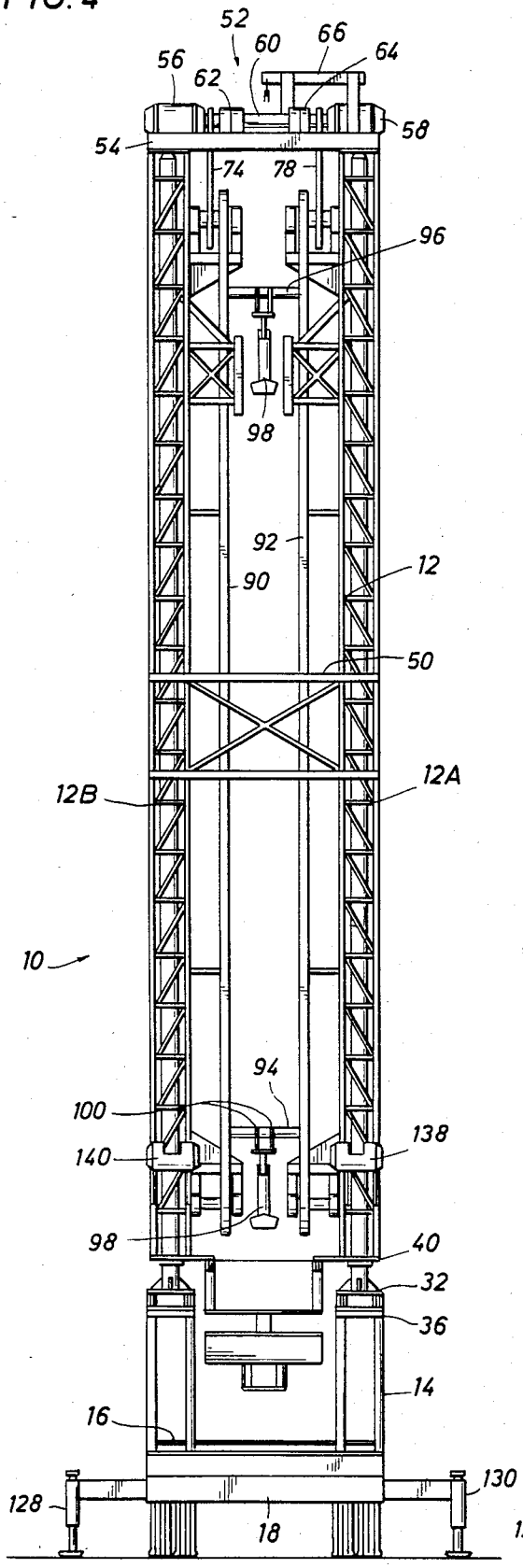
FIG. 4 is an end elevation of the vertical mast taken along line 4—4 of FIG. 3.

In FIGS. 3 and 4 the mast 12 is shown in an erect, retracted configuration. The mast 12 is erected by operation of a pair of three stage piston-and-cylinder assemblies 30 which are hingedly connected to both the skid 16 and the mast 12. The bottom of the mast 12 includes a pair of feet 32 which are pivotedly connected by hinge pins 34 to a pair of flat plates 36 forming the top of the stubstructure framework 14. Adjustable pins 38 extend from the feet 32 to form support points in contact with the flat plates 36 when the mast is in the erect configuration, in addition to the hinge pin connections 34. Swing bolts (not shown) may be used to latch the feet 32 to the flat plates 36 when these elements 32 and 36 are closed upon each other in the mast-erect configuration. The mast 12 is then locked in the erect configuration.

Figure 6:
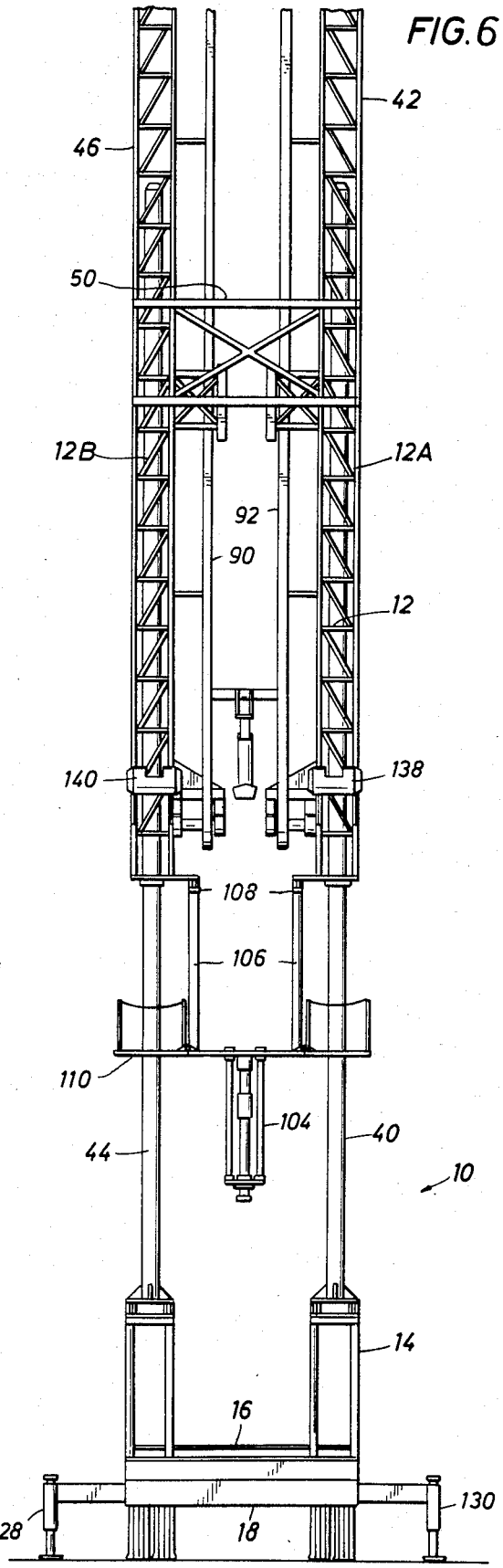
FIG. 6 is an end elevation of the rig mast extended in vertical configuration, taken along line 6—6 of FIG. 5.
Figure 5:
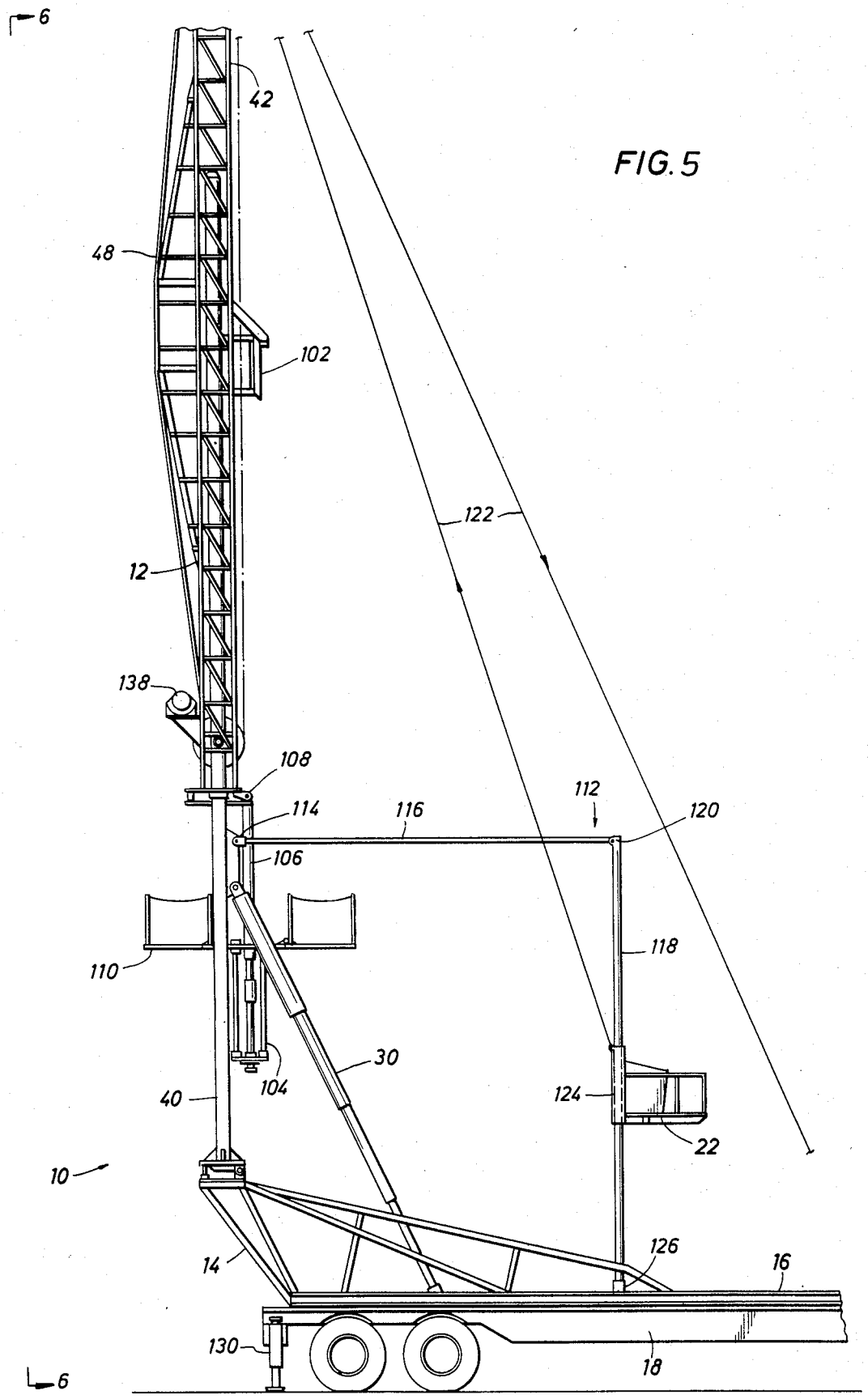
FIG. 5 is a partial side elevation of the rig mast extended in vertical configuration, with the work basket unfolded, the control console raised on the lowered control console legs, and a snubber suspended in vertical orientation.

The mast 12 may be extended upwardly as shown in FIGS. 5 and 6. As may be appreciated by reference to FIGS. 3–6, the mast 12 includes generally two legs 12A and 12B, each such leg being constructed in two sections. Thus, the leg 12A includes a gin pole 40 and a traveling pole 42. The leg 12B includes a gin pole 44 and a traveling pole 46. The gin poles 40 and 44 are generally elongate cylindrical members having at their lower ends the feet 32. Each of the traveling legs 42 and 46 features generally four elongate tubular members fastened together with a network of cross pieces and struts. A truss assembly 48 adds rigid support to the back of both traveling poles 42 and 46, and includes cross members 50 (FIGS. 2, 4 and 6) whereby the traveling poles are interconnected. Additional details of the construction of the traveling poles 42 and 46, the manner of mounting these poles on the gin poles 40 and 44, respectively, and the operation of extending the mast to the configuration shown in FIGS. 5 and 6 are disclosed in U.S. Pat. No. 4,267,675.

The traveling poles 42 and 46 are also interconnected at their respective top ends by a masthead assembly shown generally at 52. The masthead assembly includes cross members 54 linking the ends of the two traveling poles 42 and 46. Two motors 56 and 58 are mounted on the cross members 54 with their respective drive shafts aligned generally along the same axis transverse to the traveling poles 42 and 46. A coupling shaft 60 connects the drive shafts of the two motors 56 and 58, and is constrained within brackets 62 and 64 connected to the cross members 54 (FIG. 4). The coupling shaft 60 rides within suitable bearings contained within the brackets 62 and 64. A pulley support frame 66 extends generally across the masthead assembly 52 and provides support points, extending beyond the cross members 54, for pullies utilized with winch lines.

The motors 56 and 58 are utilized to operate a double chain Ferris wheel type drive assembly, shown schematically at 68 in FIG. 7. A pair of sprocket wheels 70 and 72 is carried by, and held fixed against rotational motion relative to, the motor drive shafts and the coupling shaft 60. A continuous drive chain 74 engages the sprocket wheel 70 and also engages a double-rim, or double wheel, sprocket driver 76. A similar drive chain 78 links the sprocket 72 with a double-rim drive sprocket wheel 80. A continuous working chain 82 engages the inner rim sprocket of the driver 76 and extends downwardly to engage a sprocket wheel 84. Similarly, a continuous working chain 86 engages the sprockets of the second, or inner rim of the driver 80 and extends downwardly to engage a sprocket wheel 88. Operation of the two motors 56 and 58, which motors may be hydraulically operable, is synchronized. Thus, both motors may be operated off of the same power source and through the same hydraulic feed lines, for example. Thus, virtually zero speed differential may be maintained between the two motors 56 and 58. Consequently, operation of the chain and sprocket wheel assembly 68 is carried out with the sprocket wheels 70 and 72 rotating in unison, and the wheels 84 and 88 being rotated in unison. Consequently, the working chains 82 and 86 are pulled, by means of the drivers 76 and 80, respectively, about the wheels 84 and 88 in the same rotational sense and at the same rotational rate. Therefore, for any given point in the working chain 82 moving along the continuous path defined by the configuration of the chain 82, there is a corresponding point on the working chain 86, moving at any moment in a path paralleling that of the first point on the working chain 82, and in the same direction and at the same rate.

The working chain 82 is enclosed, along most of its length, within a chain guard 90, mounted on the corresponding traveling pole 46 (FIGS. 2, 4 and 6). A similar chain guard 92 also partially encloses the working chain 86, and is mounted on the corresponding traveling pole 42.

The construction and mounting of the double-rimmed sprocket drivers 76 and 80 and of the wheels 84 and 88 and of the chain guards 90 and 92 may be more fully appreciated by reference to the aforementioned U.S. Pat. No. 4,267,675 patent.

As shown in FIG. 7, the working chains 82 and 86 may be joined together by two hoisting bars 94 and 96. Each hoisting bar 94 and 96 is joined to the working chains 82 and 86 by swivel mounts (not shown), and may support a pipe holder, such as an elevator, 98 (FIG. 4) by a pair of U-bolts 100. As the working chains 82 and 86 are propelled about the wheels 76, 84 and 80, 88, respectively, by operation of the motors 56 and 58, the hoisting bars 94 and 96 move around with the working chains while the elevators 98, for example, pass between the working chains and swing relatively freely to maintain selected orientations. Details of the construction and operation of the swivel mounted hoisting bars and of the pipe holders are provided in the U.S. Pat. No. 4,267,675 patent.

A hoisting mechanism 102 is mounted on the traveling poles 42 and 46, and used in conjunction with one or another of the hoisting bars 94 or 96 to extend or lower the traveling poles along the gin poles 40 and 44 by operation of the working chains 82 and 86, as disclosed in the U.S. Pat. No. 4,267,675 patent.

A snubber 104 may be suspended by a framework 106 generally between the lateral positions of the mast legs 12A and 12B when the mast is in the erect configuration. The frame 106 is mounted on the bottom of the traveling poles 42 and 46 by a hinge assembly 108 which permits the snubber 104 and the frame to be folded forward, toward the front of the flatbed 18. Thus, when the mast 12 is lowered to its horizontal position as shown in FIG. 1, the snubber 104 is folded under the mast 12. As the mast 12 is extended in its erect configuration, with the traveling legs 42 and 46 moving upwardly along the corresponding gin poles 40 and 44, the snubber 104 and the frame 106 are generally lifted, and are then free to swing vertically on the hinged connection 108. The frame 106 may also carry a foldable workbasket 110 shown in operating configuration in FIGS. 5 and 6 with the mast 12 erect and extended. The workbasket 110 generally folds under the mast 12 for transportation purposes, as discussed in the U.S. Pat. No. 4,267,675 patent.

The mast 12 features an additional foldable component which may be utilized to support a platform, or a work area, such as the control console 22. A pair of leg assemblies shown generally at 112 in FIGS. 3 and 5 is pivotally mounted at points 114 on the mast. Each of the legs in the assembly includes a first segment 116 joined to the mast by the pivotal connection 114, and a second segment 118 connected to the opposite end of the first segment by a pivotal, or hinged, connection 120. With the mast 12 in the erect configuration of FIGS. 3 and 5, the leg assemblies 120 may be extended, or unfolded, by means of a winch line 122 running from a winch included in the power assembly 24 (FIG. 1), for example, to a pulley carried by the pulley support frame 66 and then connected to the leg assembly in the vicinity of the hinged connection 120 on each of the two legs. As the winch is operated to lower the legs 112 from the folded configuration of FIG. 3, the first leg segments 116 pivot about the connections 114 while the second leg segments 118 retain their vertical orientation, pivoting relative to the first segments about the connections 120. Consequently, as the first segments 116 are rotated about the connection points 114, the second segment of each of the two legs 112 travels outwardly and downwardly relative to the position of the mast 12 to achieve the vertical position of FIG. 5.

The control console 22 includes a pair of upright generally tubular members 124 which receive the pair of second leg segments 118 as the latter are lowered toward the skid 16. A pair of receptacles 126 fixed to the skid receive the bottom ends of the second leg segments 118 when the latter have passed through the control console members 124. Then, the winch line 122 may be removed from the leg assembly 112 and extended downwardly to be fastened to a point on the control console 22 generally toward the back of the skid 16. The winch of the power source 24 may then be operated to draw in the winch line 122, thereby causing the control console 22 to ride up along the second leg segments 118. When the desired height of the control console 22 is reached, pins may be inserted in appropriate holes in the tubular members 124 and through corresponding holes in the second leg segments 118 to lock the control console against movement relative to the second leg segments. To lower the control console 22, the procedure is generally reversed, wherein the winch line 122 is used to lower the console to the skid 16, with the pins having been removed from the tubular members 124 to unlock the console for movement along the vertical leg segments 118.

To fold the leg assemblies 112, the winch line 122 is joined to the two leg assemblies at or near the pivot connections 120, for example, and is drawn in by the winch of the power source 24. The first leg segments 116 pivot about their corresponding connections 114 with the mast gin poles, while the second leg segments 118, remaining vertically oriented, are moved upwardly and toward the mast 12, to positions wherein both first and second segments very generally parallel the mast, as shown in FIG. 3. The leg assemblies 112 may then be fastened to the structure of the gin poles 40 and 44, and thereby held secure against the mast 12 when the mast is folded to its horizontal configuration, such as in FIGS. 1 and 2.

Horizontal adjustments of the skid 16 relative to the flatbed 18 may be made using fluid pressure systems disclosed in the U.S. Pat. No. 4,267,675 patent, for example. When the flatbed 18 has been driven into position with its rear generally centered on a well site so that the substructure frame 14, extending beyond the flatbed, straddles the well site, fine adjustments in the orientation of the substructure relative to the well site may be made along the longitudinal axis of the flatbed by operation of such a fluid pressure system to move the skid 16, on which the mast is mounted, along the flatbed.

Lateral, or sideways adjustments of the skid 16 may also be made by use of fluid pressure. The flatbed 18 is equipped with a pair of outriggers 128 and 130. The outriggers 128 and 130 may be extended, and their feet lowered to contact the surface of the ground and further advanced downwardly relative to the flatbed 18 to raise the rear wheels of the flatbed off of the ground. The extension of the outriggers may be accomplished by operation of fluid pressure systems also disclosed in the U.S. Pat. No. 4,267,675 patent. With the rear wheels of the flatbed raised off of the ground, and the flatbed being supported by the outrigger feet as well as the fifth-wheel truck 20 at the front of the flatbed, the fluid pressure cylinder assemblies used to operate the extension and retraction of the outriggers 128 and 130 may be operated in unison to swing the rear end of the flatbed 18 and, therefore, that of the skid 16 laterally relative to the longitudinal axis of the flatbed.

By utilizing the outrigger fluid pressure systems as well as the fluid pressure system to shift the skid 16 on the flatbed, the skid may be moved in two generally horizontal directions which are generally mutually orthogonal. Thus, a complete fine adjustment of the positioning of the centerline of the mast 12, when the mast is erected, may be made without the necessity of further maneuvering of the flatbed 18 by means of the truck 20.

Figure 8:
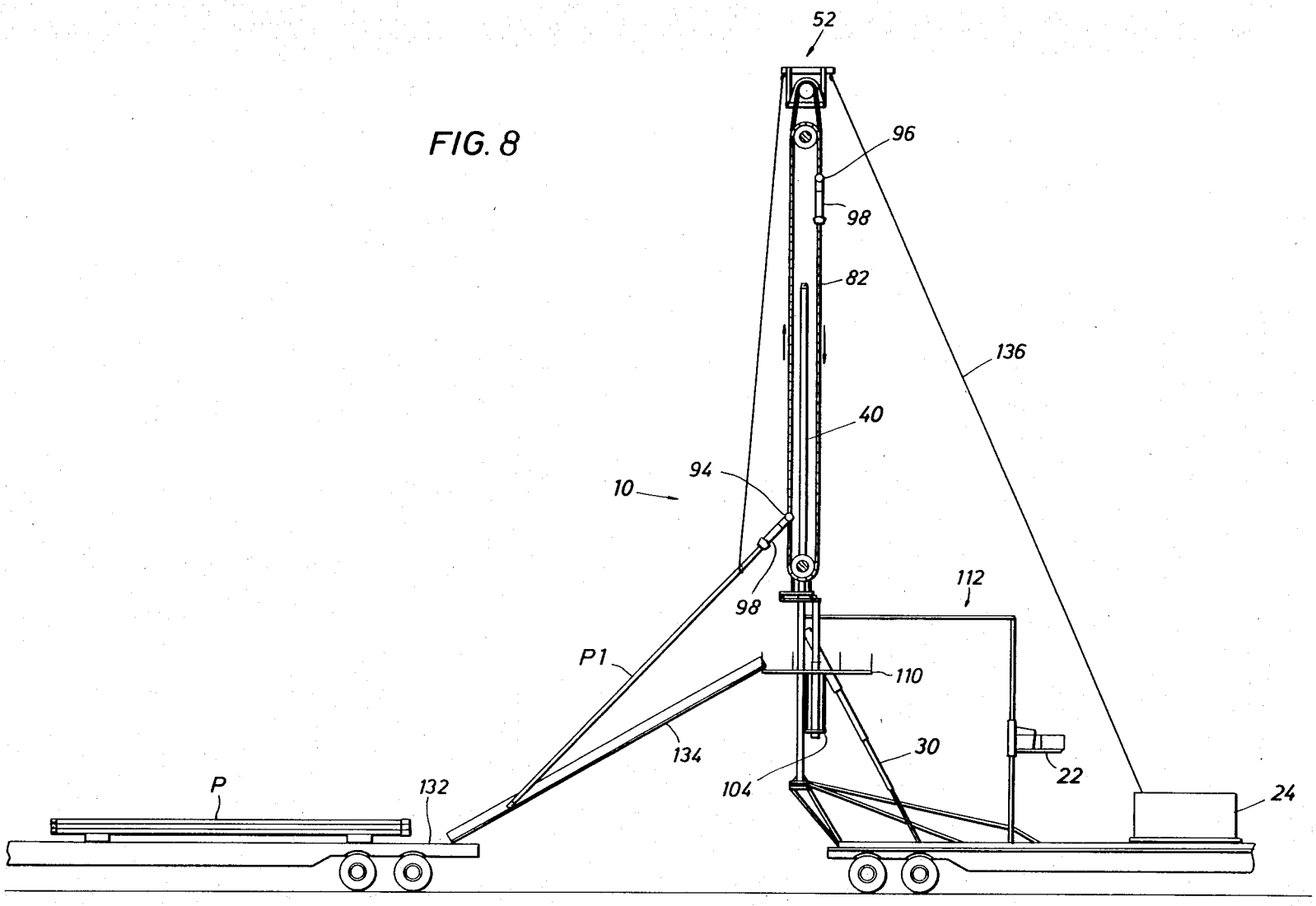
FIG. 8 is a schematic, partial side elevation of the well working rig showing one of two elevators mounted on the chain drive engaging a pipe segment.
Figure 10:
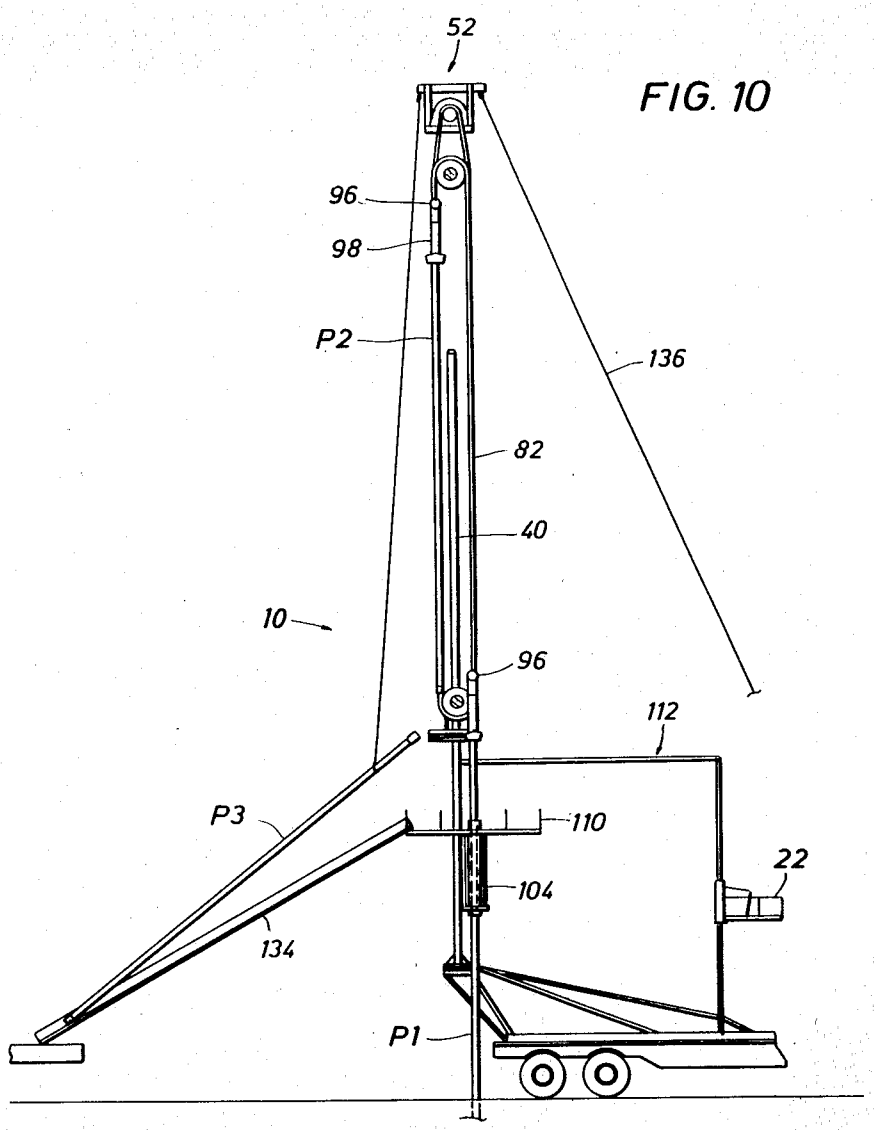
FIG. 10 is a view similar to FIGS. 8 and 9, showing the first pipe segment lowered partially into the well by the first elevator and the second pipe segment raised by the second elevator.
Figure 9:
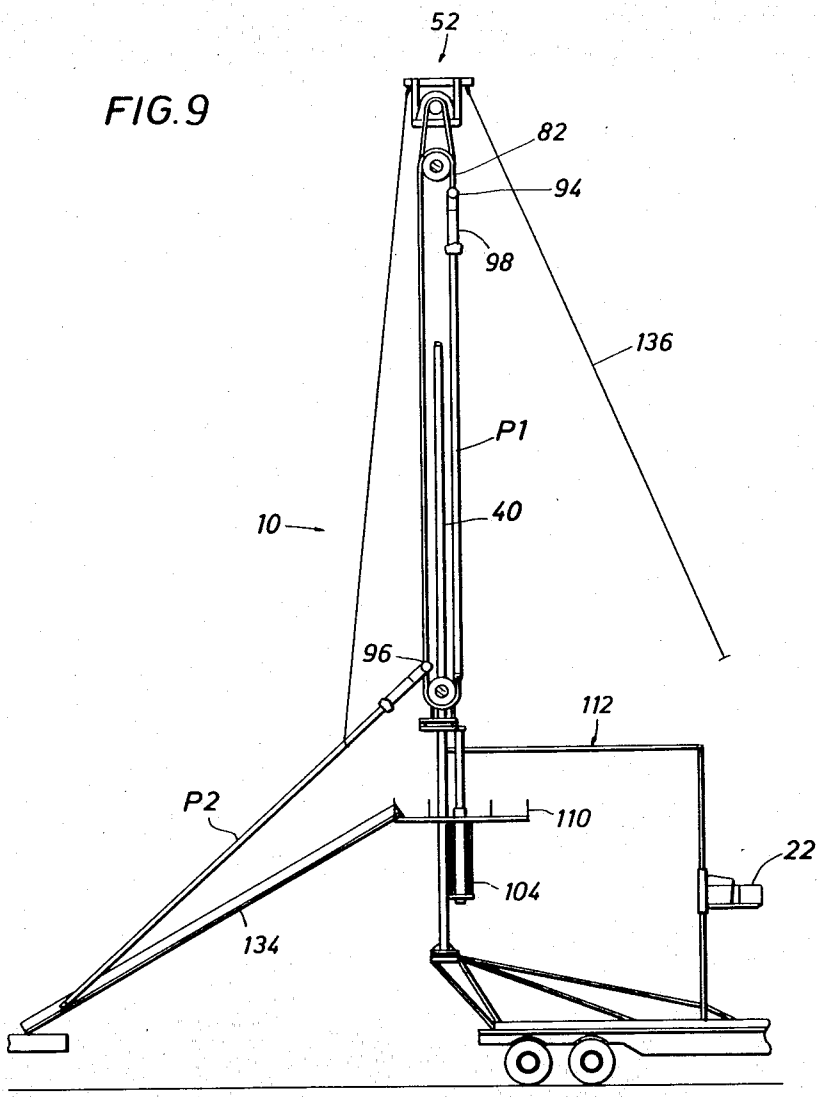
FIG. 9 is a view similar to FIG. 8, but showing a second pipe segment being engaged by the second elevator and the first pipe segment being supported over the well by the first elevator.

FIGS. 8–10 illustrate the manipulation of pipe members into, and out of, a well by means of the well working rig 10. For purposes of clarity, only certain features of the apparatus are illustrated in FIGS. 8–10.

The flatbed 18 is maneuvered into position adjacent the well site, and any necessary fine adjustments are made to position the skid 16 so that, with the mast 12 erect, the pipe handlers 98 supported along the forward legs of the working chain loops will be aligned with the centerline of the well. The mast 12 is then erected and extended. The snubber 104 is swung into position over the well site, and the workbasket 110 is unfolded. The leg assemblies 112 are lowered, and the control console 22 raised along the leg segments 118.

A collection of pipe members P may be provided toward the back of the rig 10 as shown in FIG. 8. Such pipe members may be transported by means of a truck 132. If necessary, a pipe ramp 134 may be extended from the truck 132 to the rearward edge of the work platform 110 to support pipe members being moved between the truck 132 and the mast 12. A winch line 136 may be extended from a winch of the power assembly 24 through pulleys contained in the masthead 52 and down to the pipe members P to the rear of the rig 10. A pipe member P1 may be engaged by the winch line 136, and the power assembly 24 operated to retract the winch line. Then, the pipe member P1 is raised toward the mast 12 as the lower end of the pipe member rides along the ramp 134. The upper end of the pipe member P1 may be engaged by the elevator of the pipe handling device 98 supported by, say, the hoisting bar 94. At this point, the hoisting bar 94 is positioned along the back leg of the working chain closed loops, and toward the lower end of the loops; the other hoisting bar 96 is positioned toward the top of the front of the closed loops. With the pipe member P1 engaged by the pipe holder 98, the winch line 136 may be disengaged from the pipe member P1. Then, the power assembly 24, controlled at the control console 22, may be operated to rotate the motor 56 and 58 of the masthead assembly 52 to circulate the workig chains and thereby raise the hoisting bar 94 and pipe member P1 supported thereby. As the working chains are so circulated, the pipe member P1 is lifted off of the ramp 134 and assumes a vertical orientation. The hoisting bar 94 passes over the top of the driver wheels 76 and 80, with the pipe member P1 passing generally between the working chains 82 and 86.

FIG. 9 illustrates the position and orientation of the pipe member P1 just after it has passed between the sprocket wheels, and is suspended along the front legs of the working chain closed loops. The other hoisting bar 96 is then positioned at the lower end of the back leg of the working chain closed loops, at a position to receive the next pipe member P2. The winch line 136 is again extended toward the collection of pipe members P to engage the next pipe member P2, and the power assembly 24 is operated to raise the pipe member P2 to the position shown in FIG. 9. Then, with the lower end of the pipe member P2 still resting on ramp 134, the elevator of the pipe handler 98 supported by the hoisting bar 96 is made to engage the upper end of the pipe member P2, and the winch line 136 is disengaged from the pipe member.

Continuing operation of the motors 56 and 58 lowers the pipe member P1 to the snubber 104 which may be used to force pipe members into the well. A blowout preventer and various other well site devices may be positioned between the well and the bottom of the snubber 104 as needed.

If a pipe member is already present in the well, the pipe member P1 may be rotated by appropriate means to effect a threaded connection between the pipe member P1 and the pipe member in the well.

The elevator supported by the hoisting bar 94 may then be disengaged from the pipe member P1, and the motors 56 and 58 operated to advance the working chains again. As the pipe member P1 is lowered through the snubber 104, the second pipe member P2, supported by the hoisting bar 96, is raised to the position shown in FIG. 10. The winch line 136 is employed to engage a third pipe member P3 and raise it to the position shown in FIG. 10 in anticipation of the hoisting bar 94 being moved into position to support the pipe member P3. With the pipe member P1 supported by the snubber 104, the elevator suspended below the hoisting bar 94 is disengaged from the pipe member P1 and the working chains further circulated to move the hoisting bar 94 into the position shown generally in FIG. 8. At that point, the hoisting bar 96 has been advanced to align the second pipe member P2 over the well site for lowering and engagement to the pipe member P1.

These steps are repeated until the desired pipe string is made up on the well. To remove such a pipe string from the well, the aforementioned steps are generally reversed. Thus, an elevator supported by a hoisting bar engages a pipe member projecting upwardly from the well, and the motors 56 and 58 are operated to raise the hoisting bar above the well site. Thus, the working chains are circulated in the rotational sense opposite to that used to run pipe into the well. Once the pipe member is clear of the snubber 104, the pipe member may be disengaged from the pipe member below.

Circulation of the working chains may then be effected to move the pipe member just taken from the well to the position of the back legs of the working chain closed loops. The opposite pipe handler is then in position to engage the next pipe member protruding from the snubber 104. Once the next pipe member has been engaged by the elevator supported by the opposite bar, the working chains are again circulated to lower the first pipe member onto the ramp 134 as the next pipe member is being raised above the snubber 104. With the first pipe member in the position shown generally in FIG. 9 for the pipe member P2, the winch line 136 is used to engage the upper end of that pipe member while the elevator is disengaged therefrom. Then, the first pipe member may be lowered back onto the truck 132, as the working chains are further operated to move the second pipe member removed from the well into position over the ramp 134. The elevator supported by the first hoisting bar may then engage the next pipe member to be removed from the well. This procedure is repeated until all of the pipe members desired are removed from the well and advanced to the truck 132.

Two motor winches 138 and 140 are mounted on the lower ends of the traveling poles 42 and 46, respectively (FIGS. 1–6). These motor winches 138 and 140 may be utilized in combination with winch lines extending from the respective motor winches 138 and 140 to one or more pulleys of the masthead assembly 52. Such winch lines may then be extended downwardly to engage various pieces of equipment needed to be moved. For example, one or the other of the motor winches 138 or 140 may be used in conjunction with a winch line to raise or lower the pipe members between the truck 132 and the pipe handlers 98 in the operations described in conjunction with FIGS. 8–10.

Various hydraulic systems, for example, may be used to operate the motors 56 and 58, as well as the various winches and fluid pressure systems of the rig 10. One such hydraulic system is disclosed in the U.S. Pat. No. 4,267,675 patent.

A variation of the double-chain Ferris wheel type drive assembly is shown generally at 68' in FIG. 11, wherein a dual snubber type pipe gripping head, shown generally at 142, takes the place of one of the hoisting bars and elevator type holders. Details of the construction of the gripping head 142 may be appreciated by reference to FIGS. 13–20.

Figure 14:
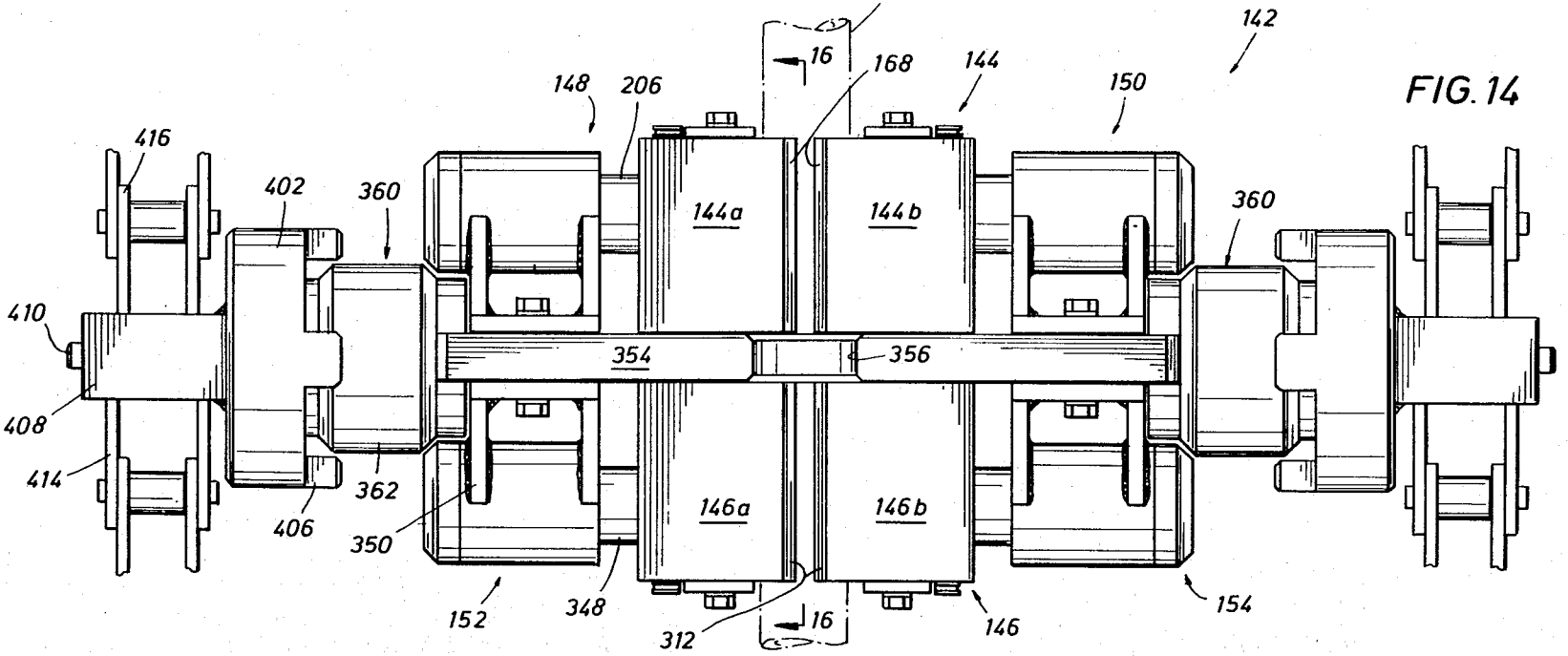
FIG. 14 is a front elevation of the snubbing head of FIG. 13, showing the dual slip bowls positioned in pipe-gripping configurations.

The pipe gripping head 142 includes upper and lower slip bowls, or housings, 144 and 146, respectively (FIG. 14). The upper slip housing 144 comprises two housing members **144*a* and 144*b*, positioned to face each other. The housing member 144*a* may be selectively driven toward and away from the opposing housing member 144*b* by a fluid pressure piston-and-cylinder assembly shown generally at 148. Similarly, the housing member 144*b* may be driven toward and away from the housing member 144*a* by a fluid pressure piston-and-cylinder propulsion assembly shown generally at 150. As discussed more fully hereinafter, the two fluid pressure assemblies 148 and 150 may be operated simultaneously to move the upper housing members 144*a* and 144*b* mutually toward each other to a retracted configuration to encompass and engage a pipe member P, for example, or to withdraw the housing members away from each other to an extended configuration, thereby expanding the upper housing 144 to release such pipe member P for movement relative to the gripping head 142**.

The lower slip housing 146 likewise comprises a pair of opposed housing members **146*a* and 146*b* operable by fluid pressure piston-and-cylinder assemblies shown generally at 152 and 154, respectively, for simultaneous movement of the housing members 146*a* and 146*b*** toward or away form each other, for example.

The aforementioned U.S. patent application Ser. No. 258,923 discloses details of construction and operation of a pipe gripping head, including one form of slip housing, and piston-and-cylinder assemblies for propelling the slip housings. Details of the construction and operation of the present propulsion assemblies and slip housings may be appreciated by reference to FIGS. 15–20 wherein interior features of these components are illustrated.

Figure 13:
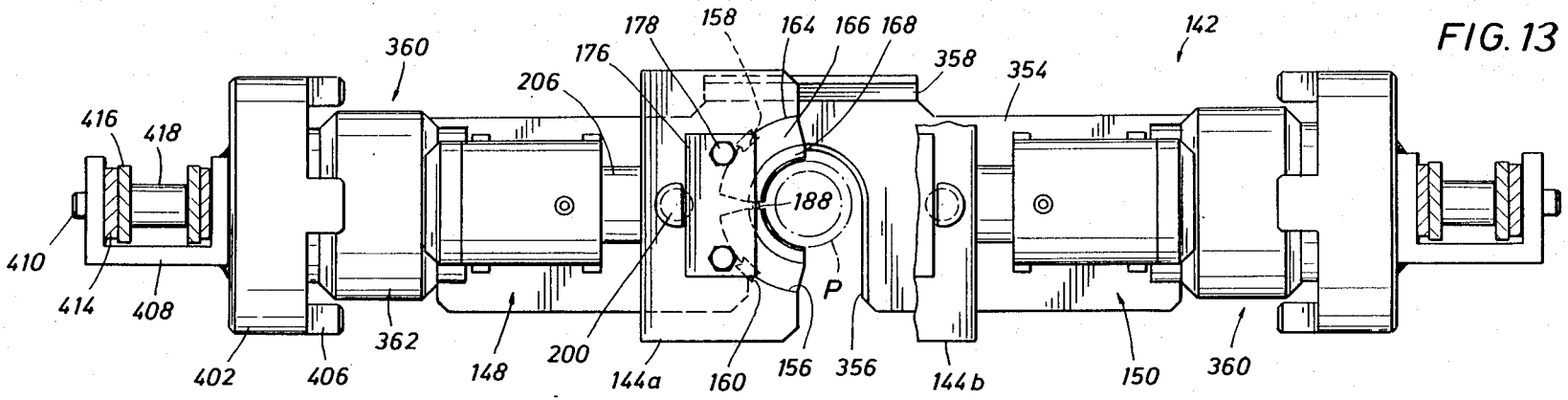
FIG. 13 is a top plan view, partly broken away and partly in section, of the snubbing head.
Figure 15:
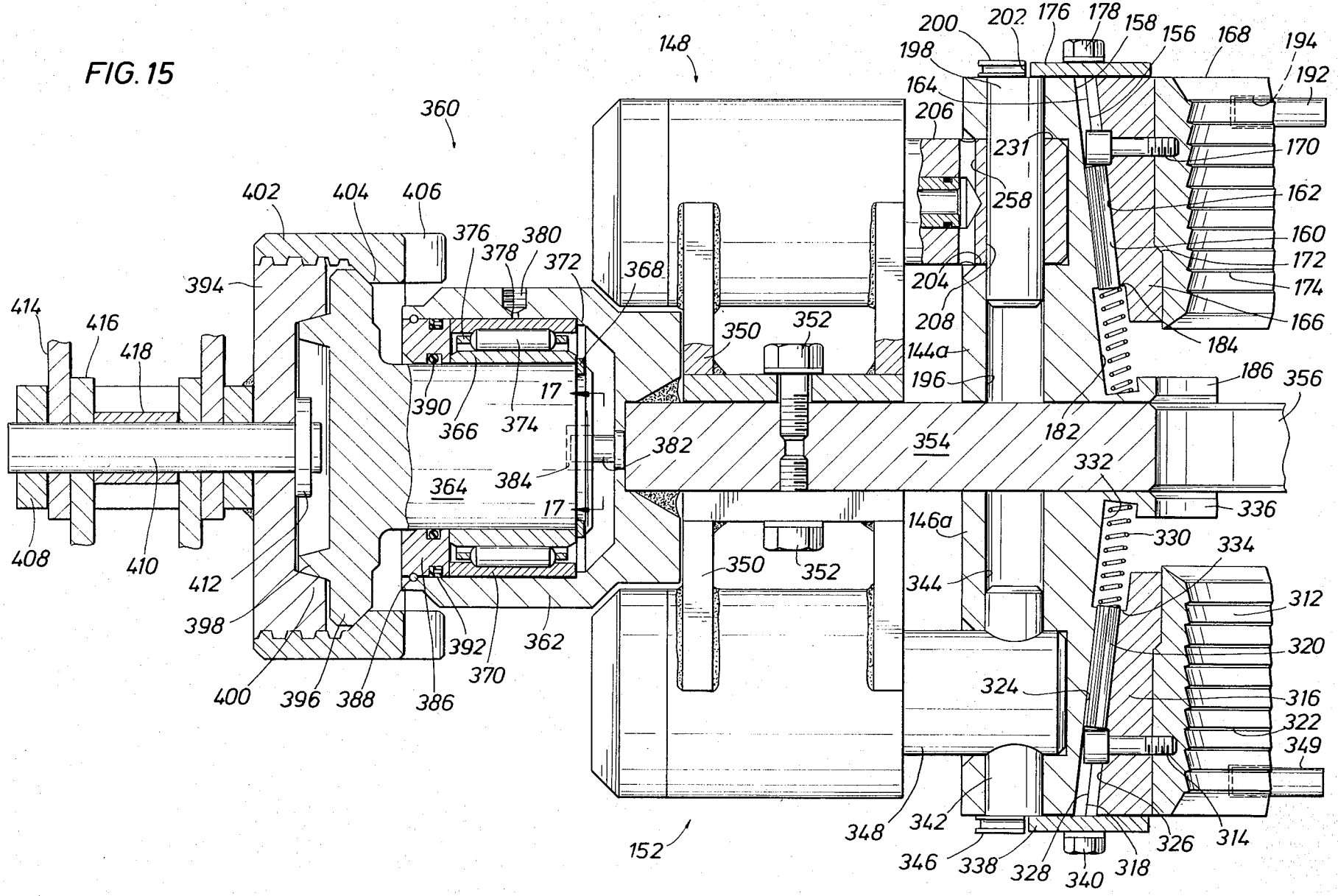
FIG. 15 is an enlarged front elevation in partial section of approximately the left half of the snubbing head as illustrated in FIG. 14.

As shown in FIG. 15, the slip housing member **144*a* features an upwardly facing surface in the form of a concave frustoconical segment 156. The face of the surface 156 is broken by two dovetail slots 158, which receive complementary dovetail locking blocks 160 (FIGS. 13 and 15). Each locking block 160 is also received within a complementary dovetail slot 162 along the back surface 164 of a separate slip holder 166. Each back surface 164 is in the form of a downwardly facing convex frustoconical segment generally complementary to the concave surface 156. The interlocking of the block 160 with the two slots 158 and 162 in each case constrains the corresponding slip holder 166 to movement along the housing slot 158, while the surfaces 156 and 164 are maintained generally in contact. Consequently, as discussed in further detail hereinafter, the generally complementary surfaces 156 and 164 establish a wedging effect whereby the housing member 144*a* may cause the slip holder 166 to be wedged against a pipe segment P (FIG. 13**).

Each of the slip holders 166 carries a slip member 168 by a bolt 170 positioned above the locking block 160 as shown in FIG. 15. The locking block 160 is thus prevented from sliding out of the slip holder slot 162. The radially outward surface of the slip 168 is generally a cylindrical segment in contact with a complementary surface area of the slip holder 166, withcomplementary frustoconical segment shoulders abutting at 172, and providing a wedging effect between the slip holder and the slip for transmitting upwardly-directed forces from the slip holder to the slip.

The radially inward surface of each slip 168 features a plurality of horizontal, arcuate gripping edges 174, facing upwardly after the fashion of buttress threads. Thus, the gripping edges 174 are oriented to grip a pipe member P and transmit upwardly-directed forces thereto (as viewed in FIG. 15).

A keeper plate 176 is held to the top of the housing member 144*a* by bolts 178 and overlies the region within the frustoconical surface segment 156 to prevent movement of the slip holder 166 and, therefore, the slips 168 from within the housing member. As illustrated in FIG. 15, the height of the housing member 144*a* is sufficient, compared to the sizes of the slip holders 166 and slips 168, to permit limited movement by the slip holders along the corresponding slanted housing member slots 158. A coil spring 180 resides in an enlarged, elongate recess 182 in the housing member 144*a*, below each of the housing dovetail slots 158, and engages a shoulder 184 formed on the back of the corresponding slip holder 166. The springs 180 maintain the respective slip holders 166 raised along the slots 158 when no pipe member is being engaged by the corresponding slips 168, and maintain the corresponding locking blocks 160 generally positioned against the respective bolts 170. Downward movement of the slip holders 166 along the slots 158 in response to forces applied to the slips 168 by pipe compresses the springs 180, which returns the slip holders to their raised positions of FIG. 15 when the force of the pipe is removed. Additionally, the housing member 144*a* continues below and under each slip 168 in a generally arcuate lip 186 which may limit the downward movement of the slips relative to the housing member when a pipe member is gripped by the slips and is applying downward forces thereto.

The two slips 168 are connected by a lateral pin 188 (FIGS. 13 and 16) which resides in appropriate bores 190 in the slips. The pin 188 is free to move a limited amount longitudinally relative to the slip holes. Thus, as the slip holders 166 are urged along the housing member surface 156, the pin 188 insures that the slips 168 and, therefore, the slip holders move generally in unison, thereby generally maximizing the gripping contact of the slips with a pipe member.

A pin 192 is carried in an appropriate bore 194 in one of the slips 168 of the housing member 144*a* (FIGS. 15 and 16), and is received in a similar bore in a slip 168 carried by the oppositely-positioned housing member 144*b*. A pin (not shown) similar to the pin 188 links the two slips of the housing member 144*b*. Thus, all four slips, and slip holders, of the upper slip housing 144 are linked by pins to insure movement in unison along a pipe member to effect maximum force-applying contact of the slip edges 174 with the pipe.

The housing member 144*a* features a vertical bore 196 which receives a locking pin 198. The pin 198 includes a head, or flange, 200 which limits the downward movement of the pin within the bore 196. The head 200 is truncated at 202 to permit the retainer plate 176 to overlie a portion of the pin 198, thereby preventing the pin from moving upwardly relative to the housing member 144*a*.

A transverse bore 204 extends within the housing member 144*a* and intersects the vertical bore 196. A piston arm 206 of the fluid pressure system 148 is received within the bore 204. A transverse bore 208 through the piston arm 206 is positioned in alignment with the housing member bore 196 so that the locking pin 198 passes within the piston arm bore 208 in the housing member bore 196. Thus, the locking pin 198 locks the piston arm 206 to the housing member 144*a* against mutual relative translational movement.

Figure 18:
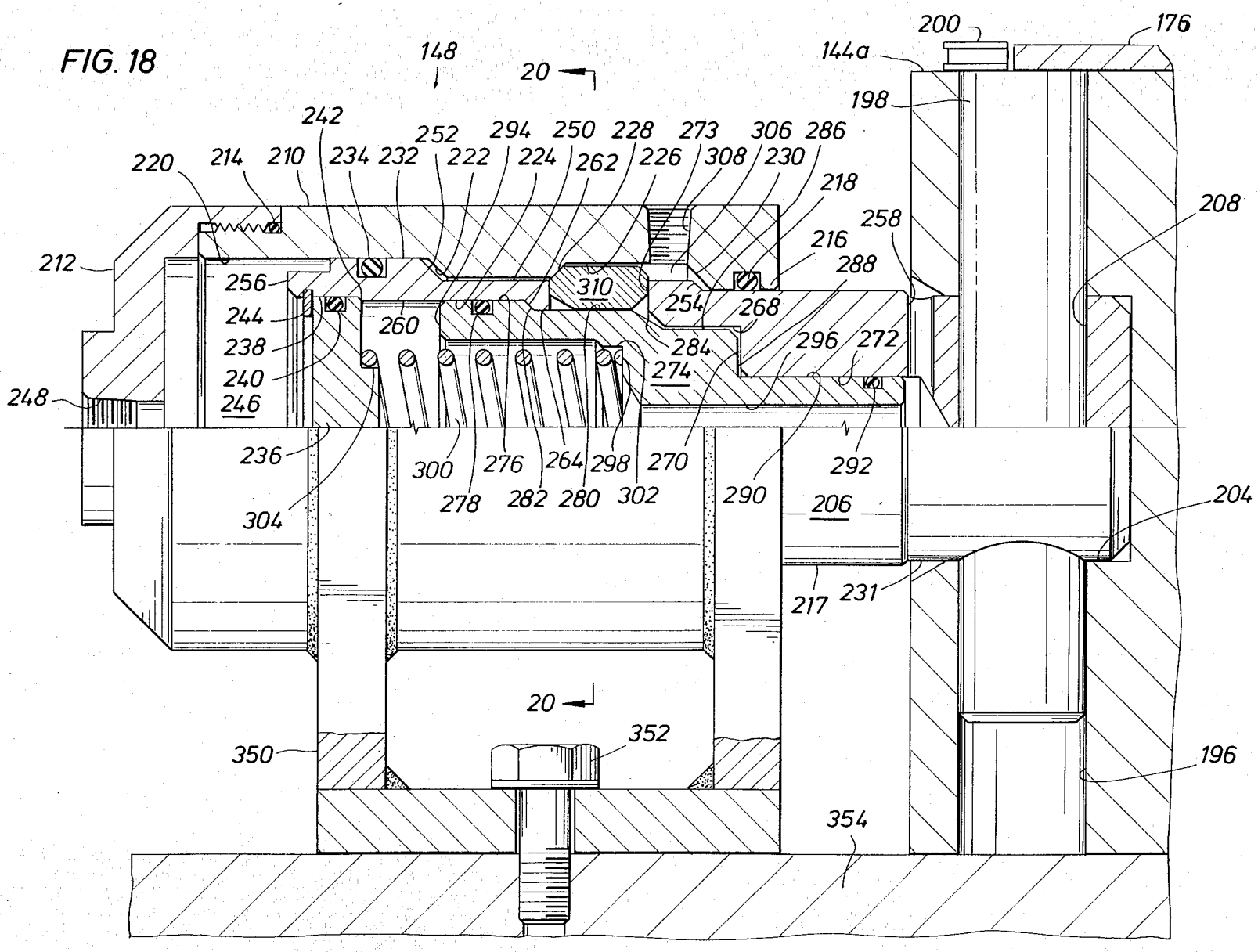
FIG. 18 is an enlarged side elevation in partial section of one snubber head fluid pressure drive assembly, showing the piston latched to the cylinder.
Figure 19:
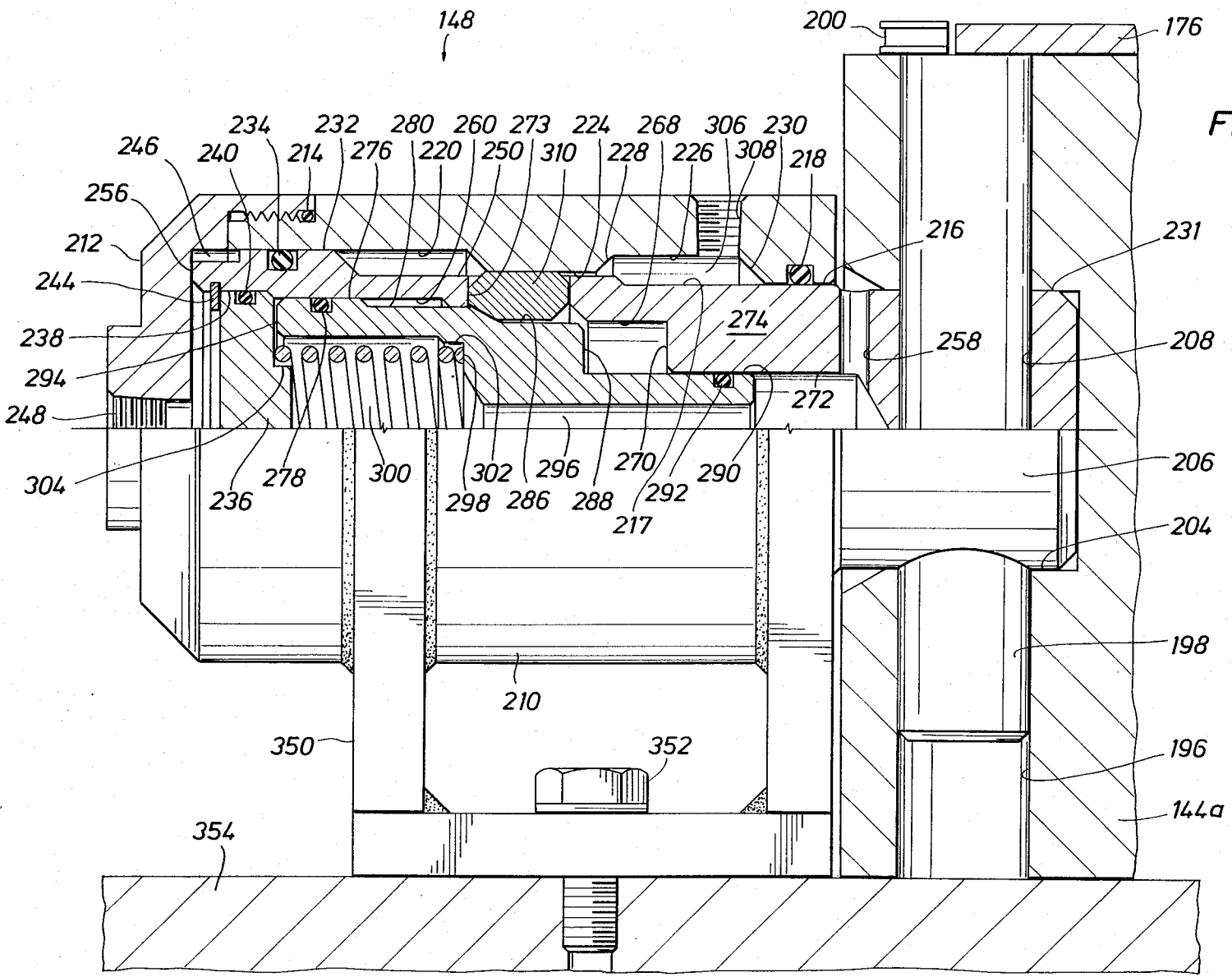
FIG. 19 is a view similar to FIG. 18, showing the drive assembly in unlatched configuration.

As shown in FIGS. 18 and 19, the fluid pressure assembly 148 further includes a fluid pressure cylinder constructed of a generally tubular body 210 with an end cap 212 threadedly engaged thereto and sealed to the tubular body by an O-ring seal 214. The opposing end of the tubular body 210 features an inwardly-directed flange 216 closely fitting about the shaft 217 of the piston arm 206, and sealed thereto by an O-ring seal 218 carried in an appropriate annular groove in the flange.

Between the flange 216 and the end cap 212, the interior of the tubular body 210 is distinguished by three internal cylindrical surfaces of differing diameters, joined by frustoconical shoulders. A first cylindrical surface segment 220 is located adjacent the end cap 212, and is connected by a frustoconical shoulder 222 to an intermediate cylindrical surface segment 224. An annular profile, or groove, is formed by a third surface segment 226, the axial limits of the groove being defined by frustoconical shoulders 228, adjacent the surface segment 224, and 230, as part of the flange 216. As may be appreciated by reference to FIGS. 18 and 19, the intermediate surface area 224 is of lesser internal diameter than either of the surface segments 220 or 226, and the internal diameter of the first surface segment 220 is greatest of all the surface segment internal diameters.

The end of the piston arm 206 is slightly diminished in outer diameter at 231 to fit within the bore 204 of the slip housing member 144*a*. At the opposite end of the piston arm 206 from the slip housing member 144*a* is a piston head assembly, including an enlarged surface portion 232, closely fitting within the cylinder surface segment 220 and sealed thereto by an O-ring seal 234 carried in an appropriate annular groove breaking the piston head surface 232. The piston arm 206 features a longitudinal bore or chamber of various diameters. The chamber of the piston arm is closed at the piston head assembly by an inset end cap 236, closely fitting within an interior surface section 238 of the piston arm and sealed thereto by an O-ring seal 240 carried in an appropriate annular groove generally circumscribing the end cap 236. Generally complementary frustoconical surfaces on the end cap 236 and the interior of the piston arm mate at 242 to limit movement of the end cap longitudinally within the piston arm interior. A split snap ring 244 resides in an appropriate groove breaking the piston arm internal surface 238 to retain the end cap 236 in place within the piston arm 206.

The piston head assembly, including the end cap 236 and the seal member 234, cooperates with the cylinder surface segment 220 and the end cap 212 sealed to the tubular member 210 by seal member 214 to define a first fluid pressure chamber 246. A threaded port 248 is provided in the end cap 212 for receiving a fluid pressure communication line (not shown) for communicating fluid pressure into or out of the pressure chamber 246.

An intermediate piston arm cylindrical surface section 250 is located between the piston head surface section 232 and the shaft 217. Frustoconical shoulders 252 and 254 separate the intermediate surface section 250 from the piston head surface 232 and the shaft surface 217, respectively. The frustoconical piston shoulder 252 is generally complementary to the cylinder frustoconical shoulder 222, and the frustoconical piston shoulder 254 is generally complementary to the cylinder frustoconical surface 230. The outer diameter of the piston surface section 250 is generally sized to fit within the cylinder intermediate surface section 224 and to be longitudinally movable relative thereto. As may be appreciated by reference to FIG. 18, movement of the piston arm 206 relative to the cylinder 210 in the longitudinal direction away from the end cap 212 is limited by abutment of the shoulders 252 and 254 with the shoulders 222 and 230, respectively, marking a first longitudinal position of the piston arm relative to the cylinder. Similarly, movement of the piston arm 206 within the cylinder 210 toward the end cap 212 is limited by abutment of the end face 256 of the piston arm at the piston head assembly with the tubular body end cap 212, marking a second longitudinal position of the piston arm relative to the cylinder, as shown in FIG. 19.

A transverse bore 258 is provided in the side of the piston arm 206 in the vicinity of the slip housing **144*a* to communicate between the interior longitudinal chamber of the piston arm and the surrounding environment for a purpose discussed hereinafter. As illustrated, the slip housing member bore 204 is tapered to facilitate such communication with the atmosphere along the piston arm bore 258**.

Between the shoulder abutments at 242, between the end cap 236 and the wall of the piston arm, and the piston arm bore 258, the interior of the piston arm 206 is distinguished by four cylindrical internal surfaces. A first cylindrical surface section 260, of somewhat lesser internal diameter than the sealing surface section 238, extends from the shoulder abutment 242 to an internal frustoconical shoulder 262. A second cylindrical internal surface 264 extends from the shoulder 262 to another internal frustoconical shoulder 266, the surface section 264 being of lesser internal diameter than that of the first surface section 260. A surface section 268, of lesser internal diameter than the surface section 264, extends between the shoulder 266 and a generally annular surface lateral 270. Between the surface 270 and the region of the bore 258 extends a cylindrical surface section 272 of the least internal diameter of the longitudinally-extending cylindrical surface sections within the piston arm 206.

The internal piston arm surface section 264 is in axial registration with a portion of the external piston arm surface 250, and with the surface 250 is broken by four arcuate apertures 273 which are symmetrically arranged about the circumference of the piston arm 206 at that axial location. As may be appreciated by reference to FIG. 18, when the piston arm 206 is in the first longitudinal pisition, the apertures 273 are in axial registration with the profile of the tubular member internal surface 226, and generally including the tubular member internal shoulder 228. As shown in FIG. 19, when the piston arm 206 is in the second longitudinal position, the apertures 273 are generally in axial registration with the tubular member internal surface portion 224.

Within the interior of the piston arm 206 is located a generally tubular mandrel, or control member, 274. The outer surface of the mandrel 274 includes a first cylindrical sealing surface 276 fitting closely within the internal piston arm surface section 260 and sealed thereto by an O-ring seal 278 carried in an appropriate annular groove breaking the sealing mandrel surface 276. A first intermediate cylindrical surface section 280 extends between an external frustoconical shoulder 282, adjacent the first cylindrical sealing surface 276, and an external frustoconical shoulder 284. The first intermediate surface section 280 is sized to fit within the internal piston arm section 264 and move longitudinally relative thereto. A second intermediate surface section 286 of the mandrel extends between the shoulder 284 and an external annular lateral surface 288, which connects the intermediate surface section 286 with a second cylindrical sealing surface 290. The mandrel surface 286 is sized to fit within the internal piston arm section 268 and to move longitudinally relative thereto. The outside diameter of the second sealing surface 290 is such that this surface fits closely within the internal piston arm surface 272 to which the surface 290 is sealed by O-ring seal 292 carried in an appropriate groove breaking the mandrel second sealing surface 290.

As may be appreciated by reference to FIGS. 18 and 19, the mandrel 274 is generally longitudinally movable within the piston arm 206 interior between a first position, as shown in FIG. 18, wherein the mandrel shoulder 282 may abut the piston shoulder 262 and the mandrel surface 288 may abut the piston surface 270, and a second position in which the annular end 294 of the mandrel is generally adjacent the piston end cap 236. In the first mandrel position of FIG. 18, the first intermediate mandrel surface 280 is generally in registration with the piston apertures 273; in the second mandrel position of FIG. 19, the second intermediate mandrel surface 286 is generally in registration with the piston apertures 273. A general internal passage 296 extends through the length of the mandrel 273, and is distinguished by an internal annular shoulder 298 facing the piston end cap 236. A coil spring 300 is axially oriented within the mandrel 273 and positioned between the mandrel shoulder 298 and the end cap 236, being centered in that position by a circumscribing mandrel internal surface 302 and by the spring generally circumscribing an end cap annular stub 304. The spring 300 thus biases the mandrel 273 toward its first position as shown in FIG. 18. Movement of the mandrel 273 toward its second position of FIG. 19 compresses the spring between the mandrel shoulder 298 and the end cap 236.

A second fluid pressure chamber 306 is formed generally between the internal surfaces of the tubular member 210, between the seal members 218 and 234, and the external surfaces of the mandrel 273 between the seal members 278 and 292. A threaded port 308 is provided in the wall of the tubular member 210 for receiving a fluid pressure communication line (not shown) for communicating fluid pressure into or out of the pressure chamber 306. Fluid pressure introduced into either the first pressure chamber 246 or the second pressure chamber 306 operates on the corresponding side of the O-ring seal 234 to urge the piston arm 206 away from or toward the tubular body end cap 212, respectively. Introduction of fluid pressure into one or the other of the pressure chambers 246 or 306 may be accompanied by controlled venting of fluid pressure out of the other of the two pressure chambers accordingly to facilitate such movement of the piston arm 206. As the piston arm 206 is thus moved due to a pressure differential acting on the O-ring 234, the slip housing member **144*a* moves with the piston arm, being fixed against movement relative to the piston arm by the locking pin 198 in piston bore 208, the internal passage 296 of the mandrel. The internal mandrel passage 296 communicates with the piston arm bore 258 in all positions of the mandrel relative to the piston arm to said pressure or vacuum blocks which might otherwise interfere with movement of the mandrel 273 within the piston arm 206**.

The piston arm 206 carries an arcuate latch member 310 in each of the four apertures 273. As may be appreciated by reference to FIGS. 18–20, each of the latch members 310 features bevelled edges, and is greater in radial thickness than the radial distance between the internal piston arm surface 264 and the external piston arm surface 250. Accordingly, when the piston arm 206 is in its first longitudinal position and the mandrel 273 is in its first position as illustrated in FIG. 18, the mandrel external first intermediate surface section 280 is in registration with the latch members 310 and maintains the latch members radially extended and residing in the tubular body internal profile provided by the groove surface 226. Then, a bevelled arcuate end of each latch member 310 abuts the internal tubular member shoulder 228, and locks the piston arm 206 against longitudinal movement relative to the tubular member 210 toward the end plate 212. When the piston arm 206 is in its second longitudinal position and the mandrel 274 is in its second position as illustrated in FIG. 19, the second intermediate mandrel surface section 285 is in registration with the latch members 310, and the latch members are radially retracted to a position between the mandrel surface 286 and the tubular member internal surface 224 of lesser internal diameter than the profile surface 226, with the latch members thus forming no impediment to longitudinal movement of the piston arm 206 relative to the tubular body 210.

The combination of the mandrel 274 and the latch members 310 serves as a latching system for locking the piston arm 206 to the cylinder 210 to limit axial movement therebetween. The mandrel 274 thus includes a first surface 280 and a second surface 286, axially spaced from the first surface and of lesser diameter, such that the first surface, when in registration with the latch members 310, maintains the latch means in an extended configuration and residing within the tubular body profile defined in part by the internal surface 226, and such that the second surface 286, when in registration with the latch members 310, permits the latch members to be in a radially retracted configuration, removed from the profile of the surface 226. It will be appreciated by reference to FIGS. 18 and 19 that the latch members 310 may be extended into the profile of the tubular body surface 226 only when the piston arm 206 is in its first longitudinal position of FIG. 18, with the apertures 273 in registration with the tubular body surface 226 and shoulder 228. Further, the mandrel 274 may be in its first position of FIG. 18, relative to the piston arm 206, only when the piston arm is in its first longitudinal position of FIG. 18 wherein the latch members 310 may be extended within the profile of the tubular body surface 226 to allow the first mandrel surface 280 to be in axial registration with the latch members as shown. Additionally, the piston arm 206 is released from locking with the tubular body 210 for axial movement relative thereto only when the mandrel 274 is in its second position relative to the piston arm, with the mandrel second surface 286 in registration with the latch members 310 as illustrated in FIG. 19, whereby the latch members are released from engagement with the tubular body within the profile of the surface 226 and the shoulder 228. Thus, operation of the biasing spring 300 in moving the mandrel 274 into its first position locks the latch members 310 within the profile of the tubular body surface 226; and, the biasing spring 300 must be compressed by the mandrel 274 being in its second position relative to the piston arm 206 to permit release of the latch members 310 from the profile of the surface 226.

For all possible positions of the piston arm 206 relative to the tubular body 210, the O-ring seals 234 and 218 maintain sealing integrity between the tubular body and the piston arm. Similarly, for all possible positions of the mandrel 274 relative to the piston arm 206, the O-ring seal members 278 and 292 maintain sealing integrity between the mandrel and the piston arm. Consequently, within the fluid pressure assembly 148, the sealing integrity of the pressure chambers 246 and 306 is maintained throughout operation of the pressure assembly.

With the piston arm 206 in its second longitudinal position, toward the end cap 212 as shown in FIG. 19, the slip housing member **144*a* is in its extended configuration relative to a pipe member, for example, with the slips 168 not engaging a pipe member. To close the slips 168 about a pipe member, as shown in FIG. 14, fluid pressure may be applied to the first pressure chamber 246 while, for example, fluid pressure is allowed to vent from the second pressure chamber 306. Due to the pressure differential across the piston head seal provided by the O-ring seal 234, the piston arm 206 is then driven to the right, as viewed in FIG. 19, driving the slip housing member 144*a* against the pipe member with which the slips 168 engage. As soon as the slip housing member 144*a* achieves its retracted configuration toward the pipe member, the piston arm 206 has achieved its first longitudinal position relative to the tubular member 210, with the apertures 273 and the latch members 310 in registration with the profile formed by the tubular body surfaces 226 and 228. Then, the mandrel 274 may move to its first position relative to the piston arm 206, and will do so, being propelled by the compressed biasing spring 300. As the spring 300 drives the mandrel 274 to its first position relative to the piston arm 206 as shown in FIG. 18, the latch members 310 are forced into extended configuration within the profile of the tubular body surface 226 by the mandrel shoulder 284 acting on the bevelled inner edge of each latch member, and the mandrel surface 280 holds the latch members so extended. Thus, as soon as the piston arm 206 is propelled to its first longitudinal position relative to the tubular member 210, to place the slip housing assembly 144*a* in its retracted configuration, the piston arm is automatically locked in place relative to the tubular body 210 by operation of the latching system including the mandrel 274 and the latch members 310, with the latching system being operated by the biasing spring 300**.

Once the piston arm 206 has achieved its first longitudinal position relative to the tubular member 210, and the mandrel 274 has been moved to its first position relative to the piston arm to maintain the latch members 310 in locking configuration within the profile of the surface 226, the pressure may be relieved from the first pressure chamber 246, since the latch members 310 will then hold the piston arm in position. Thus, fluid pressure is utilized to retract the slip housing member **144*a* by operation of the fluid pressure assembly 148, but the latching system of the mandrel 274 and the latch member 310 provides a mechanical locking of the slip housing member 144*a*** in its retracted position without need of further application of fluid pressure.

Fluid pressure is applied to the second pressure chamber 306 to both unlock the piston arm 206 for movement relative to the cylinder 210, and to propel the piston arm to its second longitudinal position of FIG. 18, thereby moving the slip housing member 144*a* to its extended position. While such fluid pressure is applied to the second pressure chamber 306, fluid pressure may be allowed to vent from the first pressure chamber 246. Fluid pressure in the second pressure chamber 306 acts on the seal between the mandrel 274 and the piston arm 206 provided by the O-ring seal member 278. Since the interior of the mandrel 274 communicates by means of the piston arm bore 258 with the atmosphere, a pressure differential is readily achieved across the seal member 278. It will be appreciated that the difference between the squares of the sealing diameters of the seal members 278 and 292 determines the effective piston area on which the fluid pressure introduced into the pressure chamber 306 may act to urge the mandrel 274 toward its second position relative to the piston arm 206, compressing the spring 300. The characteristics of the spring 300 and the effective piston area determine, at least in part, the magnitude of fluid pressure required to move the mandrel 274 against the spring. As the fluid pressure introduced into the second pressure chamber 306 moves the mandrel 274 against the spring 300 and toward its second position, the second mandrel surface 286 is brought into registration with the latch members 310, allowing the latch members to move out of the profile of the tubular member surface 226. As soon as the latch members 310 are free to move out of the profile of the surface 226, the fluid pressure differential across the O-ring seal member 234, established by the fluid pressure introduced into the second pressure chamber 306, propels the piston arm 206 to its second position of FIG. 19, thus propelling the slip housing member 144*a* toward its corresponding extended configuration, releasing gripping engagement between the slips 168 and a pipe member P. With the mandrel 274 in its second position, the effective piston area to move the piston arm 206 to its second longitudinal position is determined by the difference between the squares of the sealing diameters of the seal members 234 and 218. As the piston arm 206 moves toward its second longitudinal position with the latch members 310, the latch members are cammed radially inwardly to the retracted configuration of FIG. 19 by the tubular member shoulder 228 acting on the bevelled outer surfaces of the latch members.

Figure 20:
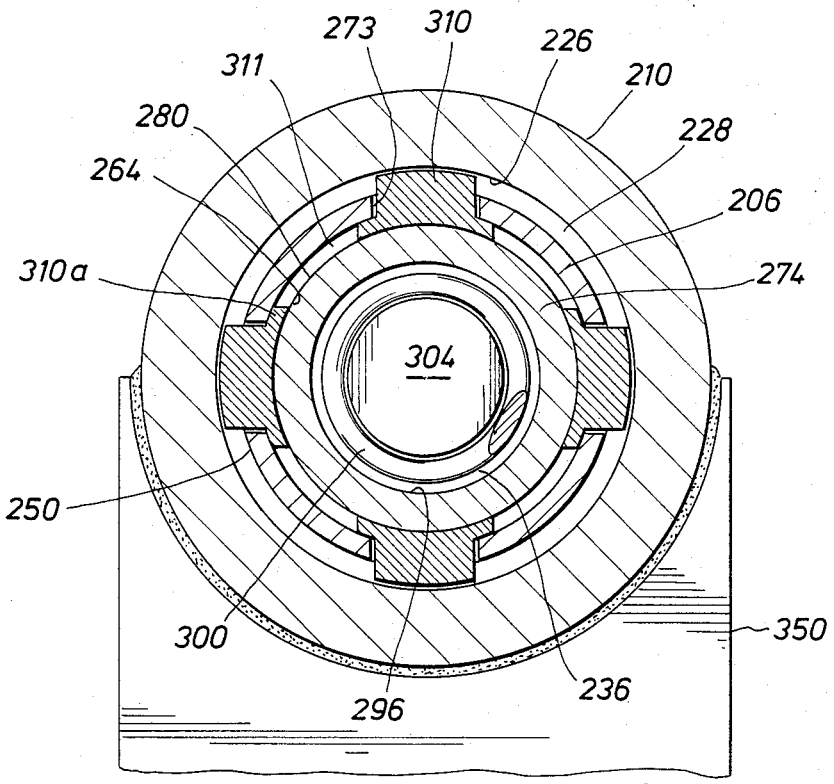
FIG. 20 is a vertical cross section of the fluid pressure drive assembly in latched configuration, taken along line 20—20 of FIG. 18.

As may be appreciated by reference to FIG. 20, the piston internal surface 268 is broken by an annular groove 311 axially aligned with the apertures 273 for receiving axially-extending side flanges 310*a* on each of the latch members 310 to limit the radially outward movement of the latch members.

The construction and operation of the fluid pressure assemblies 150, 152 and 154 may be the same as those of the fluid pressure assembly 148. The fluid presure communication ports of the two assemblies 148 and 150 associated with the upper slip housing 144 may be connected to fluid pressure supply and control systems, or the same system, so that these two fluid pressure assemblies operate in unison to move the two slip housing members 144*a* and 144*b* toward each other simultaneously, and to mutually separate the slip housing members 144*a* and 144*b* by moving them simultaneously toward their corresponding fluid pressure assemblies 148 and 150, respectively. Similarly, the fluid pressure assemblies 152 and 154 may be connected to a common fluid pressure source and control system, for example, to operate in unison, thereby moving the lower slip housing members 146*a* and 146*b* simultaneously toward or away from each other.

Additionally, the construction and operation of the upper slip housing member 144*b* may be the same as those of the slip housing member 144*a* described in detail hereinbefore, with the pin 192 being received in an appropriate bre in an opposing slip 168 of the slip housing member 144*b*. Thus, with the two slip housing members 144*a* and 144*b* being operated simultaneously by their corresponding fluid pressure assemblies 148 and 150, respectively, the slip housing members 144*a* and 144*b* may be simultaneously moved toward each other to the retracted configuration of FIG. 14 to grippingly engage a pipe member P by four gripping slips 168, moving in unison, to transmit upwardly-directed forces to the pipe member. Also, the pipe member P may be released from gripping engagement by the slips 168 by simultaneous movement of the slip housing members 144*a* and 144*b* away from the pipe member to an extended configuration in response to operation of the fluid pressure assemblies 148 and 150.

The construction and operation of each of the lower slip housing members 146*a* and 146*b* are mutually alike, and similar to the construction and operation, respectively, of the upper slip housing members 144*a* and 144*b*. As illustrated in FIG. 15, the slip housing member 146*a*, complete with a set of two pipe gripping slips 312 mounted by bolts 314 on slip holders 316 which are held to a complementary frustoconical wedging surface segment 318 of the housing member by a dovetail locking block 320, is generally an inverted version of the upper slip housing member 144*a*. Gripping edges 322 of the slip members 312 are oriented to engage a pipe member and to transmit thereto downwardly-directed forces (as viewed in FIG. 15). Each block 320 is received by complementary dovetail slots 324 and 326 in the surface 318 and the complementary frustoconical surface segment 328 of the corresponding slip holder 316, respectively. A coil spring 330 resides in an enlarged, elongate recess 332 above each of the housing dovetail slots 324, and engages a shoulder 334 formed on the back of the corresponding slip holder 316. The springs 330 urge the respective slip holders 316 downwardly along the slots 324 when no pipe member is being engaged by the corresponding slips 312, and maintain the corresponding lock blocks 320 generally positioned against the respective bolts 314. The housing member 146*b* continues above and over each slip 312 in a generally arcuate lip 336 which may limit the upward movement of the slips relative to the housing member when a pipe member is gripped by the slips and is applying upward forces thereto. A keeper plate 338, held to the bottom of the housing member 146*a* by bolts 340, underlies the slip holders 316 to prevent them from falling from within the housing member. The springs 330 cushion movement of the slip holders 316 upwardly along the housing slots 324. The keeper plate 338 also maintains a locking pin 342 within a bore 344 in the lower slip housing member 146*a*, a truncated pin head 346 limiting further movement of the pin within the housing bore. The pin 342 serves to anchor a piston arm 348 of the fluid pressure assembly 152 to the slip housing member 146*a*. A pin 349 is carried in an appropriate bore in one of the slips 312 and is received by an oppositely positioned bore in a slip 312 of the opposing housing member 146*b*. Pins (not shown) also link each pair of slips 312 in each housing member 146*a* and 146*b*. Thus, the four slips 312 may be operated to engage a pipe member in unison.

Each of the fluid pressure assemblies 148–154 is mounted on a bracket 350 which is held by one or more bolts 352 to a central beam 354. Thus, as the fluid pressure assemblies 148–154 are selectively operated to open or close one or the other or both of the slip housings 144 and 146, the retracting or extending motion of the slip housing members occurs relative to the central beam 354 due to the anchoring of the fluid pressure assemblies to that central beam. The central beam 354 features a transverse, elongate recess 356, characterized by an arcuate inner end. As illustrated in FIGS. 13 and 14, the recess 356 is positioned to receive a pipe member P which is thus encompassed and gripped by the slips of either or both of the slip housings 144 and 146 in the retracted configuration. A gusset, or beam, 358 is welded along the central beam 354 longitudinally aligned with the recess 356 and on the opposite side of the central beam to strengthen the central beam at that point (FIG. 16).

Each of the two ends of the central beam 354 is welded, for example, to a swivel assembly shown generally at 360 in FIGS. 13 and 14, with one of the swivel assemblies illustrated in detail in FIG. 15, both assemblies being alike. Each swivel assembly 360 includes a housing 362, which is welded to the end of the central beam 354. The housing 362 receives a longitudinally extending hub 364. An inner annular race 366 circumscribes the hub 364 within the housing 362, and is held in place partly by a snap ring 368 residing in an appropriate annular groove about the end of the hub. An outer annular race 370 also circumscribes the hub 364, and fits against the interior surface of the housing 362, and is held in place partly by a housing shoulder 372. A plurality of rolling bearings 374 is arrayed about an appropriate cylindrical frame 376 and confined between the inner and outer races 366 and 370, respectively. A threaded port and passageway 378 through the wall of the housing 362 and through the outer race 370 provides means for introducing lubricating fluid between the housing and the hub 364 to lubricate the roller bearings 374. The threaded port is sealed by a plug 380. The lubricated roller bearings 374 thus provide a relatively friction-free suspension between the housing 362 and the hub 364 to permit the pipe gripping assembly 142 to rotate about the longitudinal axis of the central beam 354 relative to the hub at each end of the central beam. To limit such rotation, a pair of pins 382 may be set in appropriate bores in the end of the central beam 354 and passed through appropriate holes in the housing 362 to be received in an elongate slot 384 in the end of the hub 364. As may be appreciated by reference to FIGS. 15 and 17, the degree of rotation permitted the central beam 354 relative to the hub 364 is determined by the thickness of the pins 382 and the mutual separation thereof, in addition to the width of the slot 384. Sufficient rotation may be permitted the snubbing head 142 to insure any needed movement in handling pipe members in snubbing operations as discussed hereinafter, for example. Alternatively, the pins 382 may be deleted from the snubbing head 142 to permit its complete rotation as the working chains 82 and 86 are moved about their respective closed loop paths for moving pipe entirely by means of one or more snubbing heads 142.

The generally annular region between the hub 364 and the housing 326 containing the roller bearings 374 is closed by a ring 386 which is closely fitting within the housing and about the hub, and is locked to the housing by a wire retainer 388 in appropriate grooves in the ring and housing. An O-ring seal 390 carried in an appropriate annular groove in the ring 386 seals the ring to the hub 364. A U-seal 392 carried in an appropriate annular groove in the ring 386 seals the ring to the housing 362. The ring 386 abuts the inner and outer races 366 and 370, respectively, to further confine and prevent longitudinal movement of the races.

The hub 364 is joined to an end plate 394 by a hammer union as follows. The hub 364 extends radially outwardly in a flange 396, from which longitudinally protrudes an annular shoulder 398 which is received within the confines defined by an annular shoulder 400 extending longitudinally from the end plate 394 in the opposite sense of the shoulder 398. As illustrated in FIG. 15, the shoulder 398 features an external frustoconical shape generally complementary to the abutting interior frustoconical shape of the shoulder 400. The two annular shoulders 398 and 400 are generally wedged together in response to a hammer nut 402 threadedly engaging the end plate 394 and being tightened thereto, with a radially inwardly extending flange 404 of the nut 402 overlapping and abutting the hub flange 396 and driving the latter toward the end plate 394. The hammer nut 402 includes a plurality of lugs 406 by which the threaded engagement between the nut and the end plate 394 may be tightened.

A U-shaped retainer 408 is welded to the end plate 394. A pin 410 passes through holes in both side walls of the retainer 408 as well as a hole in the end plate 394. The enlarged head 412 of the pin 410 is confined within the annular space between the end plate 394 and the hub 364 to prevent the pin from moving longitudinally out of the retainer holes. The pin 410 also passes through holes in two links 414 and 416 of the working chain 82 or 86, as well as a spacer sleeve 418. The pipe gripping head 142 is thus integrated into the two chains 82 and 86 in generally the same manner as are the hoisting bars 94 and 96 as previously discussed, and as describe further in the U.S. Pat. No. 4,267,675 patent.

With the pipe gripping head 142*a* thus mounted on the working chains 82 and 86 by the swivel assemblies 360 (and the limit pins 382 deleted), the pipe gripping head may assume any rotational orientation about its longitudinal axis. Further, the pipe gripping head 142 may be carried by the working chains 82 and 86 throughout their complete path of rotation, in just the same manner that the hoisting bars 94 and 96, supporting pipe holders such as 98 for example, may be circulated with the working chains. Further, pipe members P may be support by the snubbing head 142 as this pipe gripping device is thus circulated by the working chains 82 and 86, with the pipe members passing between the working chains from one side of the mast 12 to the other.

The hoisting mechanism 102 may also be used in conjunction with a pipe gripping head 142 to extend or collapse the mast 12 in the same manner as the hoisting bars 94 and 96 may be used for these purposes, with the housings 362 or the nuts 402 being engaged by the hoisting mechanism.

A pair of pipe gripping heads 142 may be used in place of both of the hoisting bars 94 and 96 and pipe holders such as 98. The process of making up a pipe string in a well as well as the process of removing a pipe string from a well, as described hereinbefore and illustrated in FIGS. 8–10, may be conducted with two gripping heads 142. The pipe members are then supported and manipulated by means of the pipe gripping heads 142 rather than the pipe holders 98.

The use of a pipe gripping head 142 for inserting pipe within a well, and for drawing pipe from a well, may be appreciated by reference to FIGS. 12A–E, wherein a pipe gripping head 142 is illustrated mounted on a double-chain Ferris wheel type drive assembly 68' in conjunction with a pipe holder 98', which may be of the type previously referred to as supported by the hoisting bars 94 and 96 (although two pipe gripping heads 142 may be used).

With the drive assembly 68' positioned over a well, the pipe gripping head 142 may be used as a rapid snubber in conjunction with a snubbing head 104', which may be provided by the snubber 104 supported by the framework 106 and the mast 12 as previously discussed, or just a single, fixed snubbing head. Consequently, a movable snubbing head 142 is provided in conjunction with a fixed snubbing head 104'.

A pipe member P may be raised by the pipe holder 98' from a pipe storage area (not shown) after the fashion described hereinbefore in conjunction with FIGS. 8–10. Thus, the drive assembly 68' is operated to elevate the pipe holder 98' to raise the pipe member P as shown in FIG. 12A, and to transport the pipe member between the working chain loops 82 and 86 to a position directly over the well, as shown in FIG. 12B. The pipe member P may then be lowered within the fixed snubbing head 104' which is operated to grip the pipe member P. The pipe member P is then released from the pipe holder 98', and the drive assembly 68' is again operated to position the pipe gripping head 142 along the pipe member, as indicated in FIG. 12C.

The pipe member P may be received within the recess 356 of the central beam 354, with the upper and lower gripping heads 144 and 146 both in their respective extended configurations, wherein the slip housing members are each positioned away from the recess to allow free passage of the pipe within the recess. With the pipe inserted within the recess 356, the lower slip housing members **146*a* and 146*b* are propelled radially inwardly by their respective fluid pressure assemblies 152 and 154 to grip the pipe member P with the slips 312 (FIG. 15). Then, the latch members are held in the inner profiles of the tubular bodies by the respective mandrels to lock the slip housing members 146*a* and 146*b* in position relative to the pipe member P, with the slips 312 in gripping engagement with the pipe member. The gripping head 142 will then retain such gripping engagement with the pipe member P even if the fluid pressure is released from the first pressure chambers of the fluid pressure assemblies 152 and 154. The driving assembly 68' may then be operated to propel the gripping head 142 downwardly toward the well, with the fixed snubbing head 104' in release configuration, thereby allowing the pipe member P to be driven downwardly for the stroke of the gripping head 142. The sloped, generally complimentary surfaces of the housing members 146*a* and 146*b*, the slip holders 316 and the slips 312 combine to provide a wedging effect to facilitate transmission of downwardly directed forces to the pipe to drive the pipe into the well against well fluid pressure. The springs 330 may be compressed in this operation, as the slip holders 316 and attached slips 312 are urged upwardly by the pipe P relative to the slip housing members 146*a* and 146*b***.

At the bottom of the stroke, as shown in FIG. 12D, the pipe member P has been advanced toward and into the well a distance equal to the stroke of the gripping head 142. Then, the fixed snubbing head 104' may be operated to grippingly engage and anchor the pipe member P, after which fluid pressure may be applied to the second pressure chamers of the lower fluid pressure assemblies 152 and 154 to drive the mandrels to their respective second positions, allowing the latch members to retract. The piston arms 348 are thus released from locking engagement with the respective tubular members, and are then driven radially outwardly relative to the pipe member P by the fluid pressure introduced into the second chambers, removing the slips 312 from gripping engagement with the pipe member P. The slips 312 and their corresponding slip holders return to their respective lower positions within the housing 146.

The drive assembly 68' is operated to raise the gripping head 142 relative to the pipe member P. The lower slip housing members **146*a* and 146*b* are then propelled radially inwardly to again grip the pipe member P by means of the slips 312, as shown in FIG. 12E. The fixed snubbing head 104' then releases the pipe member P, which is driven downwardly the distance of another stroke of the pipe gripping head 142, by means of operation of the drive assembly 68'**.

This stroking procedure is repeated until the pipe member P is left inserted in the well, and extending a short distance above the fixed snubbing head 104'.

With the gripping head 142 released from the pipe member P the drive assembly 68' is again used to raise a second pipe member by means of the pipe holder 98'. The second pipe member is manipulated to a position over the pipe member P already inserted within the fixed snubbing head 104', and is rotated to threadedly engage the two pipe members. The pipe holder 98' is released from the second pipe member, and the drive assembly 68' is operated to position the gripping head 42 at a location along the second pipe member.

The second pipe member is driven into the well attached to the first pipe member in the same fashion that the first pipe member was inserted within the well. Thus, the gripping head 142 is operated to grippingly engage the second pipe member by means of the slips 312 of the lower slip housing 146. The fixed snubbing head 104' releases the first pipe member P, and the drive assembly 68' is operated to propel the gripping head 142 and two pipe members downwardly relative to the well. At the end of a stroke by the gripping head 142, the fixed snubbing head 104' again grippingly engages the second pipe member in the string, and the gripping head 142 is released from the pipe member. The drive assembly 68' is operated to raise the gripping head 142 along the second pipe member, and the lower slip housing 146 is operated to grippingly engage the second pipe member again. The fixed snubbed head 104' releases the pipe members, which are then further driven into the well by a downward stroke of the pipe gripping head 142.

The process is repeated until the desired amount of pipe is made up and inserted within the well. Thus, a high speed snubbing device is provided which allows the stroke of the traveling snubbing head 142 to be relatiely rapidly effected by means of the double chain drive assembly 68'. Further, the number of strokes and the stroke length of the traveling snubbing head 142 used for each new pipe member may be varied as well conditions dictate, for example, by varying the position along the pipe to be gripped by the snubbing head at the beginning of the stroke, and/or the end of the stroke.

When well conditions and the amount of pipe made up into a string inserted within the well are such that the weight of the pipe in the well balances or exceeds the upwardly-directed forces acting on the pipe string due to well fluid pressure, the pipe gripping head 142 may be utilized to further make up and insert pipe within the well by use of the upper slip housing 144. The gripping head 142 provides support for at least some of the weight of the pipe string by means of the upwardly-directed edges 174 of the upper slips 168. Just as in the case of the gripping head upper slip housing 144 being used to lift pipe as discussed hereinafter, the combination of sloped surfaces of the housing members **144*a* and 144*b*, and of the slip holders 166 and slips 168 provides a wedge effect for transmitting upwardly-directed forces to the pipe. The springs 180 may be compressed as the pipe member urges the slips 168 and the attached slip holders 166 downwardly relative to the slip housing 144, with the spring returning the slips and slip holders to their raised positions upon release of the slips from engagement with the pipe. The pipe gripping head 142** may be used to complete a snubbing operation, even where the weight of the pipe string being inserted within the well exceeds the upwardly-directed forces acting on the pipe string due to the well pressures, without inverting the gripping head slips, for example.

Alternatively, the pipe gripping head 142 may be provided with but one slip housing, and may be used in an upright or an inverted orientation, depending on the well conditions. The gripping head 142 in that case may be selectively inverted by rotation of the gripping head about the swivel assemblies 360 for example. The limit pins 382 may be deleted to permit such rotation.

Pipe may be removed from a well, under any pressure conditions, by use of the pipe gripping head 142 by generally reversing the steps described hereinbefore. The pipe may be removed by use of a pair of gripping heads 142 positioned at opposed locations along the drive assembly 68', or by use of a single pipe gripping head 142 and a pipe holder 98'. Where, for example the pipe string weight must be supported to raise the pipe from the well, the pipe gripping head 142 is positioned over the end of a pipe string extending above and gripped by the fixed snubbing head 104' or some other pipe gripping device. The upper slip housing 144 is operated to grip the pipe and raise the pipe string with the fixed gripping device in release configuration, in much the same fashion that the pipe holders 98 may be used to raise pipe from the well as described in conjunction with FIGS. 8–10.

When a pipe member clears the lower gripping device 104', that gripping device is operated to anchor the remainder of the pipe spring, and the raised pipe griping head 142 is disengaged from the raised pipe. The drive assembly 68' is operated to position the pipe holder 98' in engagement with the raised pipe member, which is then separated from the remainder of the pipe string and placed back in the storage area, again by operation of the drive assembly 68'. The gripping head 142 is then positioned to engage the pipe string extending above and gripped by the fixed gripping device 104', and the process is repeated until all pipe desired is removed from the well.

Under conditions wherein the downhole fluid pressure exceeds the weight of the pipe string remaining in the well, the gripping head 142 may be utilized as described to remove and disengage pipe members from the pipe string. However, to accomodate the upwardly-directed forces tending to drive the pipe string out of the well, the lower slip housing 164 with its downwardly-directed slips 312 may be used to grip the pipe and control the ascent of the pipe string when the pipe string is released from gripping engagement by the fixed gripping device 104'.

The present invention thus provides a pipe gripping head which may be utilized for rapid insertion or removal of pipe relative to a well by means of a double-chain Ferris wheel type drive assembly. Since the locking of the slip housing members is mechanical, the fluid presure used to drive the slip housing members into gripping engagement with pipe members may be reduced after the pipe members have been so engaged. Further, since the fluid pressure is not used to maintain the slips in gripping engagement with the pipe, the fluid pressure thus utilized may be either hydraulic or gaseous. The locking of the slip housings in their retracted configurations is effected by positive, mechanical locking mechanisms that function automatically under the influence of biasing springs, and depend only on the positions of the corresponding piston arms to determine when the locking mechanisms lock the piston arms to the cylinder housings.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. Apparatus for manipulating pipe members comprising:

a. gripping means selectively movable generally transversely to such pipe member between a retracted configuration, in which said gripping means may grippingly engage such pipe member, and an extended configuration in which said gripping means is free from gripping engagement with said pipe member;

b. propulsion means selectively operable in response to fluid pressure for so selectively moving said gripping means between said retracted and extended configurations, and including cylinder means for receiving such fluid pressure and piston means, circumscribed by said cylinder means and connected to said gripping means and movable therewith in response to said fluid pressure to thereby so selectively move said gripping means;

c. said piston means including piston head means cooperating with said cylinder means for providing first fluid pressure chamber means, and further including internal chamber means;

d. latch means carried by said piston means, and radially movable relative thereto between an extended configuration, in which said latch means may reside at least in part in profile means within said cylinder means to releasably lock said piston means relative to said cylinder means to limit axial movement therebetween whereby said gripping means may be locked in said retracted configuration, and a retracted configuration in which said latch means is not within said profile means;

e. control means movable longitudinally within said internal chamber means between a first position, in which said control means maintains said latch means in said extended configuration of said latch means, and a second position in which said control means permits said latch means to be in said retracted configuration of said latch means;

f. biasing means for urging said control means toward said first position; and g. second fluid pressure chamber means defined, at least in part, by said cylinder means, said piston means and said control means;

h. wherein application of fluid pressure to said first fluid pressure chamber means may propel said piston means to move said gripping means to said retracted configuration of said gripping means whereby said biasing means may move said control means to said first position to maintain said latch means in said extended configuration of said latch means within said profile means to thereby automatically, releasably lock said gripping means in said retracted configuration of said gripping means, and wherein application of fluid pressure to said second fluid pressure chamber means may propel said control means to said second position, permitting said latch means to move to said retracted configuration of said latch means to release said gripping means from being locked in said retracted configuration of said gripping means and whereupon said application of fluid pressure to said second fluid pressure chamber means may propel said piston means to move said gripping means to said extended configuration of said gripping means.

2. Apparatus as defined in claim 1 wherein said control means comprises mandrel means, movable longitudinally within said piston means between said first and second positions, comprising a first portion and an axially spaced second portion of less diameter than said first portion, said first portion when in registration with said latch means in said first position preventing disengagement of said latch means from said profile means, and said second portion when in registration with said latch means in said second position allowing disengagement of said latch means from said profile means.

3. Apparatus as defined in claim 2 in which said piston means comprises apertures in which latch members of said latch means are mounted for radial movement between extended positions, in which said latch members engage said profile means, and retracted positions, in which said latch members are not in engagement with said profile means.

4. Apparatus as defined in claim 2 further comprising seal means, providing fluid-tight sealing between said mandrel means and said piston means, and defining, in part, said second fluid pressure chamber means.

5. Apparatus as defined in claim 1 wherein said latch means comprises at least one latch member movable between a locking configuration in said extended configuration of said latch means, in which said latch member resides in said profile means to effect locking engagement between said piston means and said cylinder means, and a release configuration in said retracted configuration of said latch means in which said latch member is withdrawn from said profile means to disengage said locking engagement between said piston means and said cylinder means.

6. Apparatus as defined in claim 5 wherein said biasing means comprises spring means for biasing said latch member into locking engagement with said profile means, and said latch member may be released from engagement with said profile means by application of fluid pressure to said second fluid pressure chamber means.

7. Apparatus as defined in claim 1 wherein said gripping means further comprises slip means mounted on at least two members so movable by operation of said propulsion means between said extended configuration and said retracted configuration.

8. Apparataus as defined in claim 1 wherein said gripping means comprises a first gripping assembly including means for engaging such pipe members and transmitting force thereto in one longitudinal direction sense of such pipe members, and a second gripping assembly including means for engaging such pipe members and transmitting force thereto in the opposite longitudinal direction sense of such pipe members.

9. Apparatus as defined in claim 8 wherein each of said first and second gripping assemblies is independently, selectively operable to grip and release pipe members.

10. Apparatus as defined in claim 1 wherein:

a. said latch means comprises a plurality of latch members mounted for radial movement within apertures in said piston means;

b. said control means comprises mandrel means including first surface means and second surface means axially spaced from and of less diameter than said first surface means, whereby when said control means is in said first position said first surface means is in registration with said latch members for maintaining said latch members in said extended configuration, and when said control means is in said second position said second surface means is in registration with said latch members for permitting said latch members to be in said retracted configuration; and c. said biasing means comprises spring means interacting between said piston means and said mandrel means for urging said mandrel means toward said first position.

11. Apparatus as defined in claim 10 wherein said piston means is so movable longitudinally relative to said cylinder means between a first longitudinal position with said gripping means retracted and a second longitudinal position with said gripping means extended, whereby said apertures are in registration with said profile means when said piston means is in said first longitudinal position to allow said latch members to move to said extended configuration, and said apertures are not in registration with said profile means when said piston means is in said second longitudinal position.

12. Apparatus as defined in claim 10 wherein said profile means comprises internal groove means for receiving said latch members.

13. Apparatus as defined in claim 1 wherein said piston means is so movable longitudinally relative to said cylinder means between a first position with said gripping means retracted and a second position with said gripping means extended, whereby said latch means may move to said extended configuration of said latch means when said piston means is in said first longitudinal position, and said latch means is constrained to said retracted configuration of said latch means when said piston means is in said second longitudinal position.

14. Apparatus as defined in claim 1 further comprising:

a. mast means;

b. continuous chain means, extending generally longitudinally along at least a portion of said mast means;

c. wheel means mounted on said mast means for maintaining said chain means so extended; and d. power means, positioned generally toward a first end of said mast means, for selectively propelling said chain means about said wheel means in a first rotational sense or a second rotational sense opposite the first rotational sense;

e. wherein said gripping means and propulsion means are joined to said continuous chain means and movable therewith as said power means so propels said chain means.

15. Apparatus as defined in claim 14 further comprising swivel means for joining said gripping means to said chain means whereby said gripping means may be selectively oriented throughout a range of directions relative to said chain means while said chain means is so propelled about said wheel means.

16. Apparatus as defined in claim 14 wherein said gripping means comprises a first gripping assembly including means for engaging such pipe members and transmitting force thereto in one longitudinal direction sense of said pipe members, and a second gripping assembly including means for engaging such pipe members and transmitting force thereto in the opposite longitudinal direction sense of said pipe members.

17. Apparatus as defined in claim 16 wherein each of said first and second gripping assemblies is independently, selectively operable to grip and release pipe members.

18. Apparatus as defined in claim 14 wherein said gripping means further comprises slip means mounted on at least two members as parts of said gripping means so movable by operation of said propulsion means between said extended configuration and said retracted configuration.

19. Apparatus as defined in claim 14 wherein:

a. said continuous chain means comprises two closed chain loops;

b. said wheel means comprises a first sheave assembly positioned generally toward said first end of said mast means, and a second sheave assembly positioned along said mast means generally in the opposite direction relative to said first sheave assembly; and c. said power means comprises motor means for connecting to said first sheave assembly whereby said power means is selectively operable to propel said first sheave assembly in said first or second rotational sense.

20. Apparatus as defined in claim 19 wherein:

a. said continuous chain means further comprises drive chain means;

b. said wheel means further comprises a drive wheel assembly whereby said drive chain means is connected to said motor means; and c. said drive chain means is connected to said two closed chain loops by said first sheave assembly.

21. Apparatus as defined in claim 14 wherein said control means comprises mandrel means, movable longitudinally within said piston means between said first and second positions, comprising a first portion and an axially spaced second portion of less diameter than said first portion, said first portion when in registration with said latch means in said first position preventing disengagement of said latch means from said profile means, and said second portion when in registration with said latch means in said second position allowing disengagement of said latch means from said profile means.

22. Apparatus as defined in claim 21 in which said piston means comprises apertures in which latch members of said latch means are mounted for radial movement between extended positions, in which said latch members engage said profile means, and retracted positions, in which said latch members are not in engagement with said profile means.

23. Apparatus as defined in claim 21 further comprising seal means, providing fluid-tight sealing between said mandrel means and said piston means, and defining, in part, said second fluid pressure chamber means.

24. Apparatus as defined in claim 14 wherein said latch means comprises at least one latch member movable between a locking configuration in said extended configuration of said latch means, in which said latch member resides in said profile means to effect locking engagement between said piston means and said cylinder means, and a release configuration in said retracted configuration of said latch means in which said latch member is withdrawn from said profile means to disengage said locking engagement between said piston means and said cylinder means.

25. Apparatus as defined in claim 24 wherein said biasing means comprises spring means for biasing said latch member into locking engagement with said profile means, and said latch member may be released from engagement with said profile means by application of fluid pressure to said second fluid pressure chamber means.

* * * * *